US005300407A

United States Patent [19]

Matsuoka et al.

[11] Patent Number: 5,300,407

[45] Date of Patent: Apr. 5, 1994

[54] SILVER HALIDE PHOTOGRAPHIC MATERIAL CONTAINING IMIDAZOPYRAZOLE TYPE COUPLER AND IMAGE FORMING METHOD USING SAID COUPLER

[75] Inventors: Koshin Matsuoka; Tadahisa Sato, both of Kanagawa, Japan

[73] Assignee: Fuji Photo Film Co., Ltd., Kanagawa, Japan

[21] Appl. No.: 801,396

[22] Filed: Dec. 2, 1991

[30] Foreign Application Priority Data

Dec. 7, 1990 [JP] Japan ..... 2-400948

[51] Int. Cl.[5] ..... G03C 7/38

[52] U.S. Cl. ..... 430/386; 430/387; 430/558

[58] Field of Search ..... 430/558, 386, 387

[56] References Cited

U.S. PATENT DOCUMENTS 4,500,630 2/1985 Sato et al. ..... 430/558

FOREIGN PATENT DOCUMENTS 0000556 1/1989 Japan ..... 430/558
1028638 1/1989 Japan ..... 430/558
1-106057 4/1989 Japan ..... 430/558
253745 10/1989 Japan .
096133 4/1990 Japan .

*Primary Examiner*—Lee C. Wright
*Attorney, Agent, or Firm*—Birch, Stewart, Kolasch & Birch

[57] ABSTRACT

An image forming method is disclosed which comprises developing a silver halide photographic material with a developing solution containing an aromatic primary amine developing agent in the presence of an imidazo[1,2-b]pyrazole type coupler represented by the following general formula (I):

(I)

wherein $R_1$ represents a hydrogen atom, an alkyl group, an alkoxy group, an aryloxy group or an aryl group; $R_2$ represents an alkoxy group, an aryloxy group or an amino group; $R_3$ represents a hydrogen atom, an alkyl group or an aryl group; and X represents a hydrogen atom or a group capable of being released upon coupling with an oxidation product of an aromatic primary amine developing agent.

The magenta coupler represented by general formula (I) is excellent in color reproducibility, sensitivity and color density.

A silver halide color photographic material containing the magenta coupler is also disclosed.

18 Claims, 1 Drawing Sheet

SILVER HALIDE PHOTOGRAPHIC MATERIAL CONTAINING IMIDAZOPYRAZOLE TYPE COUPLER AND IMAGE FORMING METHOD USING SAID COUPLER

FIELD OF THE INVENTION

The present invention relates to a silver halide photographic material and an image forming method, and more particularly to a silver halide photographic material containing a novel imidazopyrazole type coupler having an improved color forming property and an image forming method using the coupler.

BACKGROUND OF THE INVENTION

It is well known that an aromatic primary amine color developing agent oxidized by exposed silver halide as an oxidizing agent reacts with a coupler to form a color image.

Magenta color image forming couplers which have been widely used in practice and on which various investigations have been made are almost always 5-pyrazolones. However, it is known that dyes formed from 5-pyrazolone type couplers have an undesirable absorption of the yellow component in the region around 430 nm, which causes color turbidity.

In order to reduce the yellow component absorption, a pyrazolobenzimidazole nucleus as described in British Patent 1,047,612, an indazolone nucleus as described in U.S. Pat. No. 3,770,447, a pyrazolo[5,1-c]-1,2,4-triazole nucleus as described in U.S. Pat. No. 3,725,067, a pyrazolo[1,5-b]-1,2,4-triazole nucleus as described in JP-A-59-171956 (the term "JP-A" as used herein means an "unexamined published Japanese patent application") and U.S. Pat. No. 4,540,654 and an imidazo[1,2-b]pyrazole nucleus as described in JP-A-59-162548 and U.S. Pat. No. 4,500,630 have been proposed as a magenta color image forming coupler skeleton.

Among them, pyrazolo[5,1-c]-1,2,4-triazole type magenta couplers and pyrazolo[1,5-b]-1,2,4-triazole type magenta couplers (both types of couplers are generally referred to as pyrazolotriazole type couplers hereinafter) are particularly useful and have been practically employed in some silver halide color photographic materials.

Dyes formed from the pyrazolotriazole type couplers are superior to those formed from conventional 5-pyrazolones in view of the undesirable absorption of the yellow component and they are also preferred from a standpoint of color reproduction since their absorption spectra sharply decrease to zero on the longer wavelength side.

The inventors have found, however, that these pyrazolotriazole type couplers have the undesirable properties described below, although they have the above described excellent properties. When these couplers are used together with silver halide, which acts as an oxidizing agent for an aromatic primary amine developing agent necessary for a color forming reaction, and more specifically, when an emulsified dispersion of the couplers and a silver halide emulsion are mixed to form a coating and its photographic characteristics are evaluated, the silver halide emulsion does not have its original sensitivity, gradation or fog, and as a result the sensitivity may increase or decrease depending on the emulsion used and the resulting color density decreases. Such facts can be determined by a comparison of these results with those obtained by color development or black and white development of a coating prepared by incorporating a 5-pyrazolone type coupler under the same conditions. Also, some of these facts can be confirmed by a comparison with those results obtained by black and white development of a coating containing only the silver halide emulsion.

It is not essentially expected that the couplers used in silver halide color photographic materials have any effect on the silver halide emulsions used except for couplers having a specific function such as development inhibitor releasing couplers or developing accelerator releasing couplers. Particularly, it is undesirable to have an effect on a light sensitive process and cause sensitization or desensitization. With recent silver halide photographic materials in which rapid processing capability is required, it is strongly desired not to influence the silver halide emulsion.

The inventors have confirmed that pyrazolotriazole type couplers have stronger interaction with silver ion or silver halide in comparison with compounds having a 5-pyrazolone residue which have hitherto been widely used as magenta couplers, specifically to effect the formation of complex or adsorption. Further, it has been confirmed that such an interaction causes desensitization of the emulsion and a decrease in color reproduction.

The inventors have determined that the undesirable interaction of a pyrazolotriazole type coupler with silver is difficult to control and turned his attention to an imidazopyrazole nucleus for solving the problem. However, dyes formed from compounds having an imidazopyrazole nucleus are apt to have their spectral absorption in a shorter wave length region as compared with those formed from pyrazolotriazole type couplers and they are not preferred in view of color reproduction.

SUMMARY OF THE INVENTION

Therefore, one object of the present invention is to provide a novel coupler which does not cause an interaction with silver halide like pyrazolotriazole type couplers but which has excellent color reproducibility like pyrazolotriazole type couplers.

Another object of the present invention is to provide an image forming method which results in excellent color reproducibility, sensitivity and color density.

A further object of the present invention is to provide a silver halide color photographic material which results in excellent color reproducibility, sensitivity and color density.

Other objects of the present invention will become apparent from the following description and examples.

As a result of intensive investigations, the inventors have found that imidazopyrazole compounds having a specific substituent on their nuclei do not suffer from the undesirable interaction with silver which is observed with pyrazolotriazole type couplers. The inventors have also found that the present invention can exhibit excellent color reproducibility, sensitivity and color density.

The present invention also relates to an image forming method, which comprises developing a silver halide photographic material with a developing solution containing an aromatic primary amine developing agent in the presence of an imidazo[1,2b]pyrazole type coupler represented by the following general formula (I):

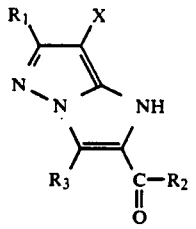

(I)

wherein $R_1$ represents a hydrogen atom, an alkyl group, an alkoxy group, an aryloxy group or an aryl group; $R_2$ represents an alkoxy group, an aryloxy group or an amino group; $R_3$ represents a hydrogen atom, an alkyl group or an aryl group; and X represents a hydrogen atom or a group capable of being released upon coupling with an oxidation product of an aromatic primary amine developing agent.

Also, the present invention is directed to a silver halide color photographic material comprising a support having thereon at least one layer containing the magenta coupler represented by the general formula (I) described above.

BRIEF DESCRIPTION OF THE ACCOMPANYING DRAWING

FIG. 1 is a graph showing the absorption spectra of azomethine dyes obtained from the coupler according to the present invention and from a comparative coupler, respectively.

DETAILED DESCRIPTION OF THE INVENTION

Figure 1:
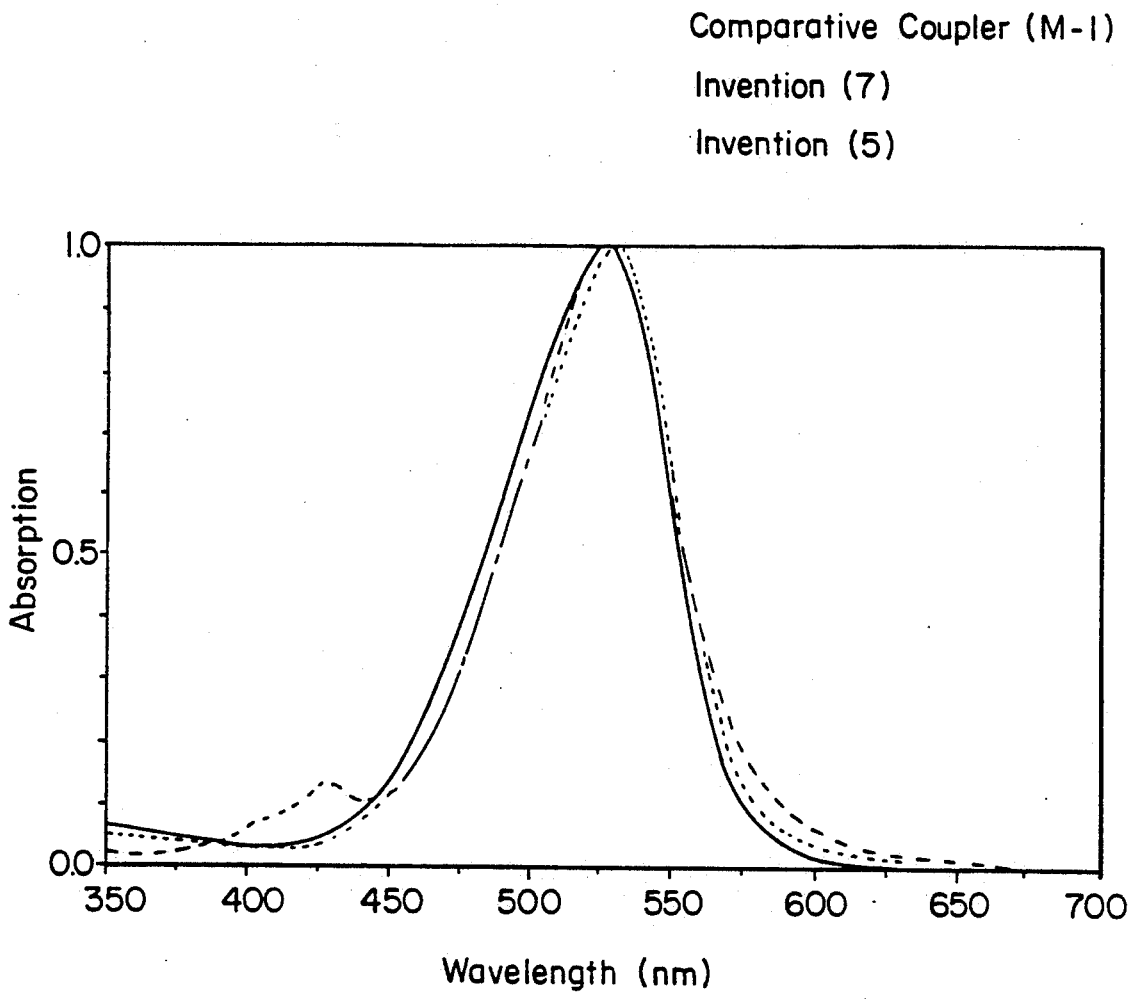

The substituents represented by $R_1$, $R_2$, $R_3$ and X in general formula (I) will be explained in detail below.

$R_1$ represents a hydrogen atom, an alkyl group, an alkoxy group, an aryloxy group or an aryl group. Also, $R_1$ is a substituent having the Hammett's $\sigma_p$ value of not more than 0.1, preferably from −0.5 to 0.05, and more preferably from −0.20 to 0.03.

The Hammett's rule is an empirical rule which was proposed by L. P. Hammett in 1935 in order to quantitatively examine the effect of a substituent on a reaction or equilibrium of a benzene derivative and its use is widely recognized at present.

The substituent constants obtained by the Hammett's rule include σp values and σm values and these values are described in detail in many references, for example, J. A. Dean (Ed.) *Lange's Handbook of Chemistry*, 12th Edition (McGraw Hill, 1979) and *Kagaku no Ryoiki Zokan*, Vol. 122, pages 96 to 103 (Nankodo, 1979).

In the present invention, a substituent on the aryl group represented by $R_1$ is defined by the substituent constant σp value. It should be noted that the substituents are not limited to those having their known value described in references, and include substituents having the Hammett's substituent constant σp value within the above described range when determined based on the Hammett's rule, even if the values of the substituents are not described in references.

The σp values of representative substituents are shown below.

| | | | |
|---|---|---|---|
| $-NHCH_3$ | −0.84 | $-N(CH_3)_2$ | −0.83 |
| $-OCH_3$ | −0.32 | $-C(CH_3)_3$ | −0.20 |

-continued

| | | | |
|---|---|---|---|
| $-CH_3$ | −0.17 | $-C_6H_5$ | 0.01 |

When the σp value exceeds 0.1, the coupling activity of the coupler tends to decrease and problems occur mainly in sensitivity and color density that is produced. On the other hand, when the σp value is less than −0.5, the absorption spectrum of an azomethine dye formed is present in a short wavelength region and its hue is not suitable as a good magenta dye, resulting in a problem in color reproduction.

The alkyl group includes a substituted or unsubstituted, straight chain or branched chain alkyl group, and is preferably a substituted or unsubstituted, straight chain or branched chain alkyl group having from 1 to 32 carbon atoms.

The substituent which may present in the alkyl group includes a group bonded through an oxygen atom, a nitrogen atom, a sulfur atom or a carbonyl group, an alkyl group, an aryl group, a heterocyclic group, a cyano group, and a halogen atom. The group bonded through an oxygen atom, a nitrogen atom, a sulfur atom or a carbonyl group includes a hydroxy group, an amino group, a nitro group, a carboxy group, an acyl group, an aryloxycarbonyl group, an alkoxycarbonyl group, a carbamoyl group, an alkoxy group, an aryloxy group, a heterocyclic oxy group, an acyloxy group, a carbamoyloxy group, a silyloxy group, an aryloxycarbonylamino group, an acylamino group, an anilino group, an alkylamino group, a ureido group, a sulfamoylamino group, an alkoxycarbonylamino group, a sulfonamido group, an imido group, an alkylthio group, an arylthio group, a heterocyclic thio group, a sulfamoyl group, a sulfonyl group or a sulfinyl group.

The alkoxy group includes a group composed of a substituted or unsubstituted, straight chain or branched chain alkyl group bonded to an oxygen atom, and is preferably a group composed of a substituted or unsubstituted, straight chain or branched chain alkyl group having from 1 to 32 carbon atoms bonded to an oxygen atom. The alkyl moiety of the alkoxy group may have further substituents selected from those described for the above alkyl group.

The aryloxy group includes an unsubstituted or substituted aryloxy group and the substituents may include those described above for the alkyl group. The preferred aryloxy group includes an unsubstituted phenoxy or naphthyloxy group and a phenoxy or naphthyloxy group substituted with the substituents selected from those described above for the alkyl group.

Specific examples of the more preferred aryloxy group include a phenoxy group, a 2-methylphenoxy group, a 4-tert-butylphenoxy group, a 3-nitrophenoxy group, a 3-tert-butyloxycarbamoylphenoxy group, a 3-methoxycarbamoylphenoxy group, a 1-naphthyloxy group and a 2-naphthyloxy group.

The aryl group includes an unsubstituted aryl group and an aryl group substituted with one or more substituents, which may be the same or different, each having the Hammett's σp value of not more than 0. Preferred examples of the aryl group include an unsubstituted phenyl or naphthyl group and a phenyl or naphthyl group substituted with one or more substituents, which may be the same or different, each having the Hammett's σp value of not more than 0 such as an alkyl group, an aryl group, an alkoxy group, an aryloxy group, an acylamino group, a urethane group or a ureido group. Specific examples of more preferred aryl groups include a phenyl group, a 2,4,6-trimethylphenyl group, a 1-tert-butylphenyl group, an o-aminophenyl group, an o-methoxyphenyl group, a p-dimethylaminophenyl group, an m-methoxymethylphenyl group, an m-methoxyethoxyphenyl group, a p-trimethylsilylphenyl group, a 1-naphthyl group and a 2-naphthyl group.

$R_1$ preferably represents an alkyl group, an aryloxy group or an alkoxy group, and more preferably an alkyl group or an aryloxy group.

$R_2$ represents an alkoxy group, an aryloxy group or an amino group.

The alkoxy group and aryloxy group each has the same meaning as described above.

The amino group includes an unsubstituted or substituted amino group represented by the following formula:

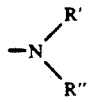

wherein R' and R'', which may be the same or different, each represents a hydrogen atom, an alkyl group or an aryl group, or R' and R'' may combine with each other to form a ring.

The alkyl group represented by R' or R'' has the same meaning as described above. The aryl group represented by R' or R'' includes an unsubstituted aryl group and an aryl group substituted with one or more substituents selected from those described above for the alkyl group.

Among the amino groups represented by the above formula,, those wherein either R' or R'' or both each represents an unsubstituted or substituted, straight chain or branched chain alkyl group having from 1 to 32 carbon atoms are preferred.

$R_2$ preferably. represents an alkoxy group or a substituted amino group, and more preferably an alkoxy group or an N,N-substituted amino group.

$R_3$ represents a hydrogen atom, an alkyl group or an aryl group. The alkyl group has the same meaning as described above. The aryl group is unsubstituted or substituted group, in which one or more positions are substituted by the same substituents as defined above for the alkyl group.

$R_3$ preferably represents an alkyl group or an aryl group. As for alkyl group, an unsubstituted or substituted, straight chain or branched chain alkyl group having from 1 to 32 carbon atoms is preferred. As for aryl group, an ortho-substituted aryl group is preferred and ortho-disubstituted aryl group is more preferred.

X represents a hydrogen atom, a halogen atom (for example, fluorine, chlorine, bromine, or iodine), a carboxy group, a group bonded to the coupling position through an oxygen atom (for example, acetoxy, propanoyloxy, benzoyloxy, 2,4-dichlorobenzoyloxy, ethoxyoxaloyloxy, vinyloxy, cinnamoyloxy, phenoxy, 4-cyanophenoxyl, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, or 2-benzothiazolyloxy), a group bonded to the coupling position through a nitrogen atom (for example, benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-5-ethoxy-3-hydantoinyl, 2N-1,1-dioxo-3(2H)-oxo-1,2-benzosothiazolyl, 2-oxo-1,2-dihydro-1-pyridinyl, imidazolyl, pyrazolyl, 3,5-diethyl-1,2,4-triazol-1-yl, 5- or 6-bromobenzotriazol-1-yl, 5-methyl-1,2,3,4-tetrazol-1-yl, or benzimidazolyl) , or a group bonded to the coupling position through a sulfur atom (for example, phenylthio, 2-carboxyphenylthio, 2-methoxy-5-tert-octylphenylthio, 4-methanesulfonylphenylthio, 4-octanesulfonamidophenylthio, benzylthio, 2-cyanoethylthio, 1-ethoxycarbonyltridecylthio, 5-phenyl-2,3,4,5-tetrazolylthio, or 2-benzothiazolyl).

X preferably represents a halogen atom or a group bonded through a sulfur atom.

Also, $R_1$, $R_2$, $R_3$ or X may be a divalent group to form a bis group.

When the moiety represented by general formula (I) is included in a vinyl monomer, the vinyl group may further have a substituent in addition to the coupler moiety represented by general formula (I). Preferred examples of such a substituent include a hydrogen atom, a chlorine atom or a lower alkyl group having from 1 to 4 carbon atoms (for example, methyl, or ethyl).

The monomers including the coupler moiety represented by general formula (I) may form a copolymer together with non-color forming ethylenic monomers which do not undergo coupling with the oxidation products of aromatic primary amine developing agents.

Examples of the non-color forming ethylenic monomers which do not couple with the oxidation products of aromatic primary amine developing agents include an acrylic acid (for example, acrylic acid, α-chloroacrylic acid, or an a-alkylacrylic acid such as methacrylic acid), an ester or an amide derived from an acrylic acid (for example, acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, or β-hydroxy methacrylate), methylene bisacrylamide, a vinyl ester (for example, vinyl acetate, vinyl propionate, or vinyl laurate), acrylonitrile, methacrylonitrile, an aromatic vinyl compound (for example, styrene and a derivative thereof, for example, vinyl toluene, divinyl benzene, vinyl acetophenone, or sulfostyrene), itaconic acid, citraconic acid, crotonic acid, vinylidene chloride, a vinyl alkyl ether (for example, vinyl ethyl ether), maleic acid, maleic anhydride, an ester of maleic acid, N-vinyl-2-pyrrolidone, N-vinyl pyridine, and 2- or 4-vinyl pyridine. Two or more non-color forming ethylenically unsaturated monomers described above can be used together. For example, a combination of n-butyl acrylate and methyl acrylate, styrene and methacrylic acid, methacrylic acid and acrylamide, or methyl methacrylate and diacetoneacrylamide can be employed.

The non-color forming ethylenically unsaturated monomer which is used to copolymerize with a solid water-insoluble monomer coupler can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

Polymer couplers which can be used in the present invention may be water-soluble couplers or water-insoluble couplers. Particularly, polymer couplers in the form of a latex are preferably used.

The coupler represented by general formula (I) according to the present invention can be employed by incorporating into a light-sensitive material or a developing solution. The amount of the coupler is preferably from $1\times10^{3}$ to 1 mol per mol of silver, more preferably from $1\times10^{-1}$ to 1 mol per mol of silver in the case of using said coupler in a light-sensitive material, and when using said coupler in a developing solution, it is preferably from 1 to 6 g per liter, more preferably from 2 to 3 g per liter of the developing solution.

Specific examples of the representative magenta couplers (1) to (41) according to the present invention are set forth below, but the present invention should not be construed as being limited thereto.

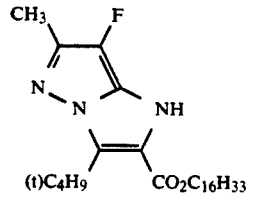

(1)

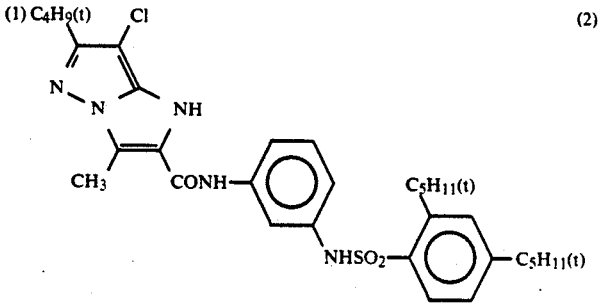

(2)

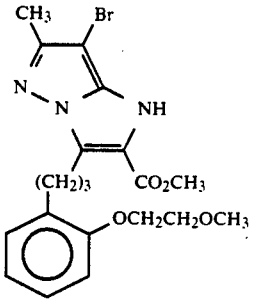

(3)

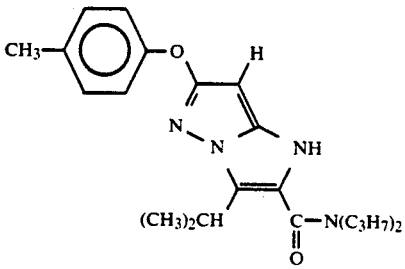

(4)

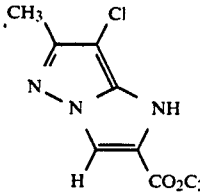

(5)

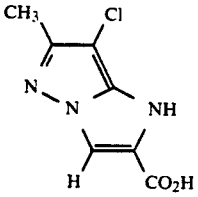

(6)

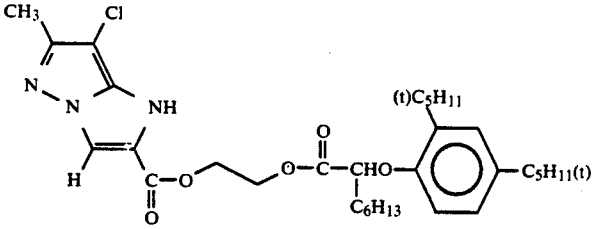

(7)

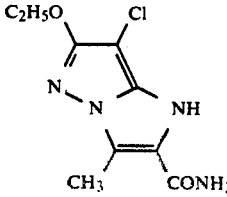

(8)

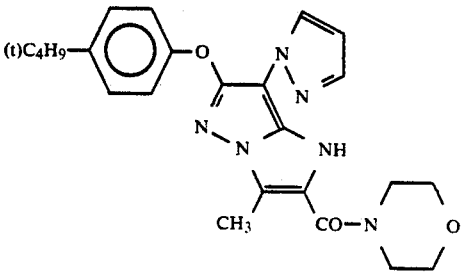

(9)

-continued
(10)
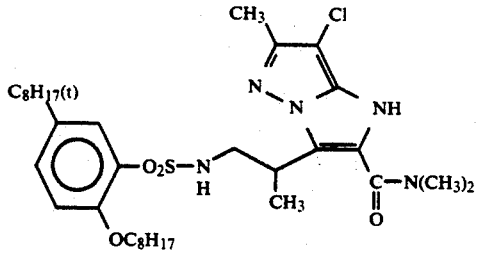
(11)
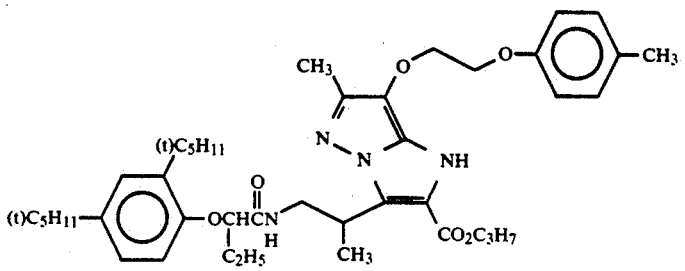
(12)
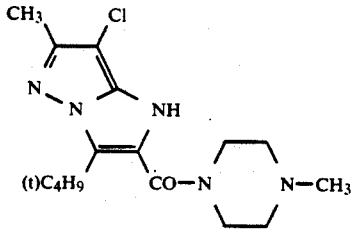
(13)
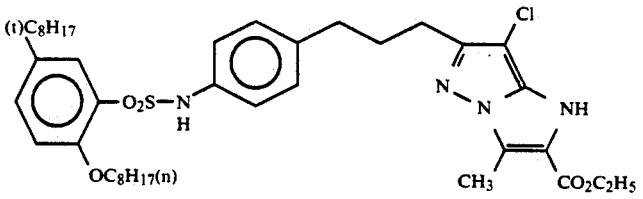
(14)
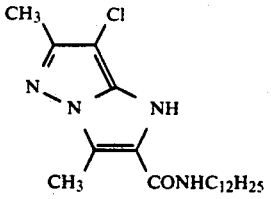
(15)
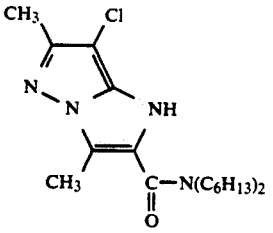
(16)
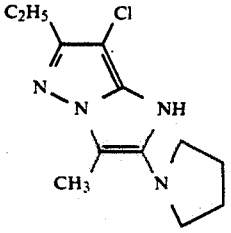
(17)
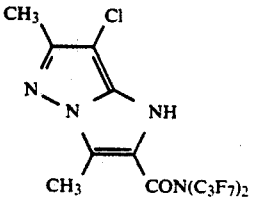

-continued
(18)
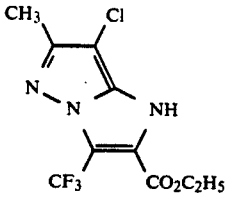
(19)
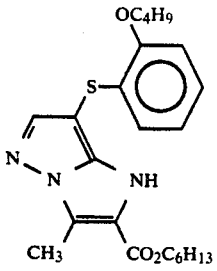
(20)
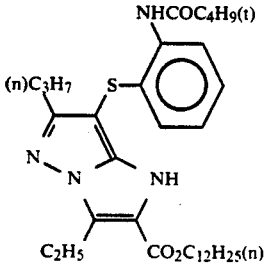
(21)
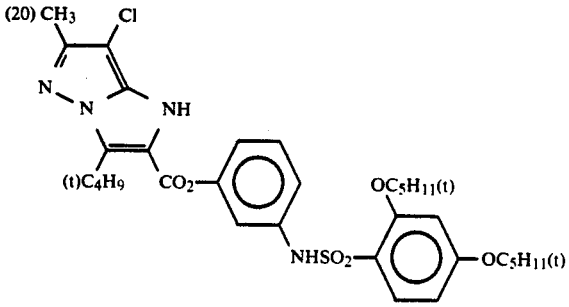
(22)
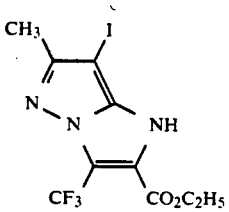
(23)
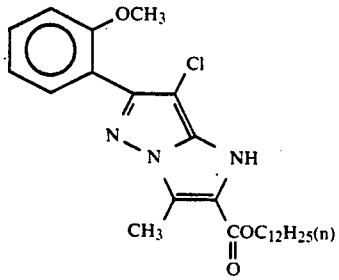
(24)
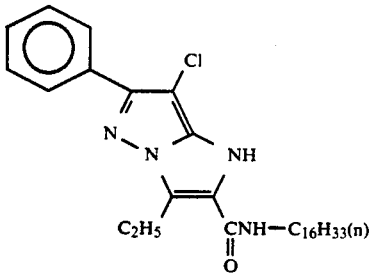
(25)
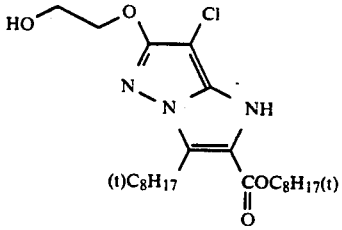
(26)
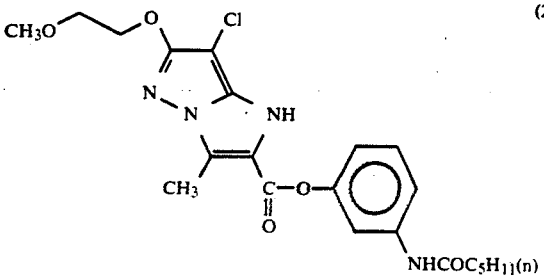
(27)
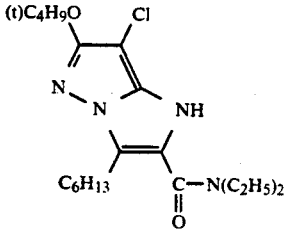

-continued
(28)
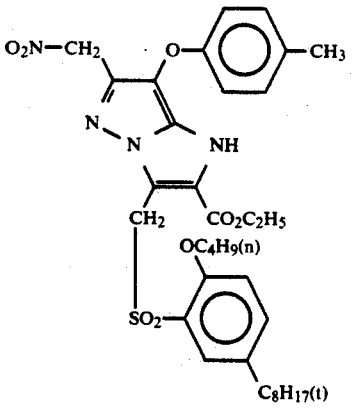
(29)
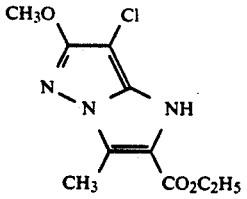
(30)
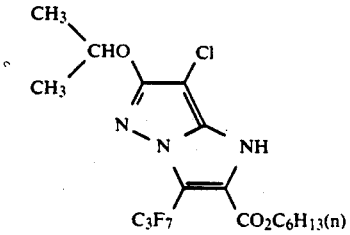
(31)
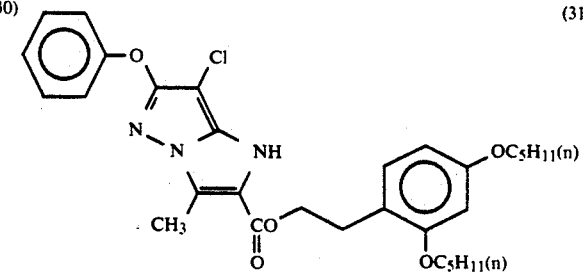
(32)
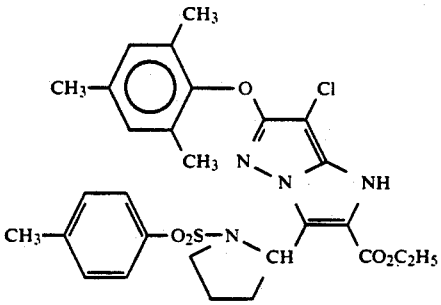
(33)
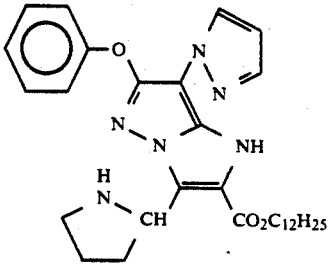
(34)
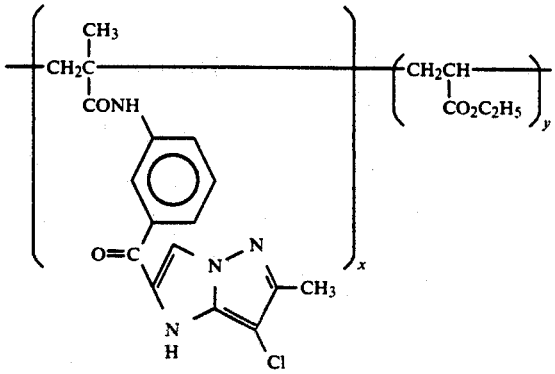
x:y = 50:50

-continued
(35)
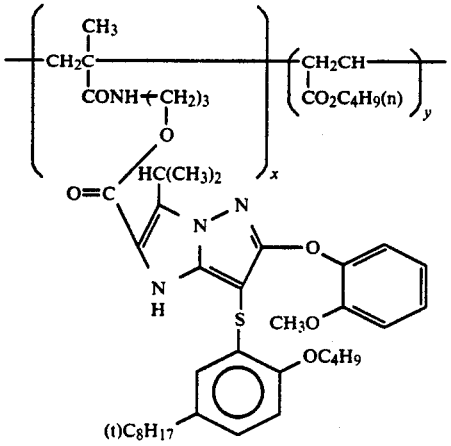
x:y = 45:55
(36)
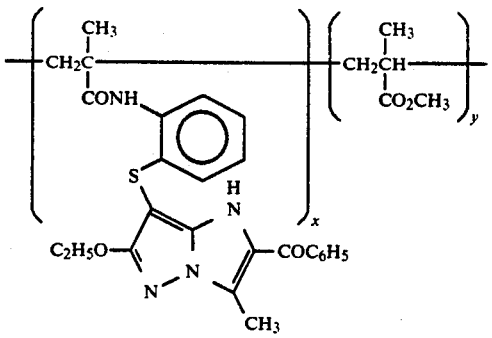
x:y = 50:50
(37)
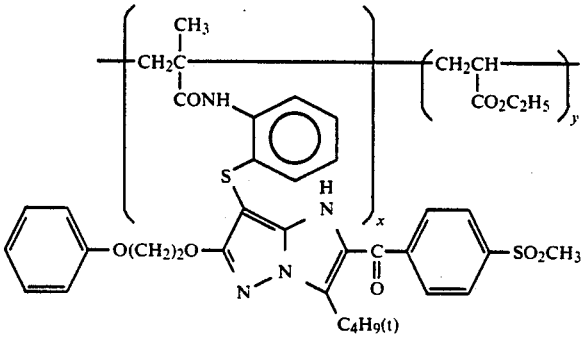
x:y = 45:55
(38)
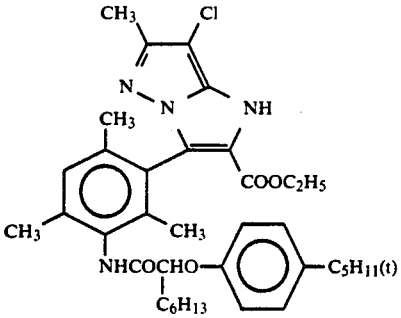
(39)
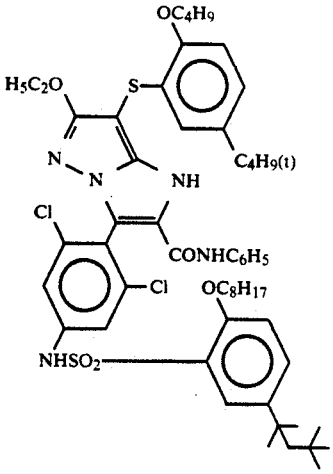

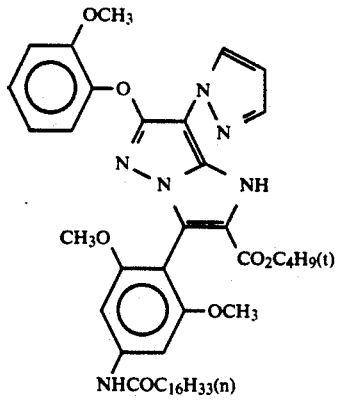

A method for the synthesis of the coupler according to the present invention is described below. A general method for the synthesis of the coupler of the invention can be illustrated by the following reaction scheme:

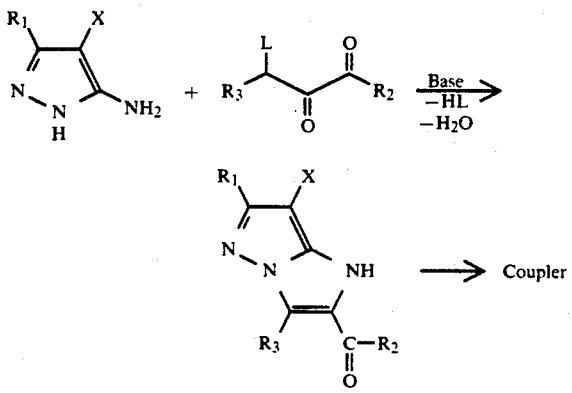

wherein $R_1$, $R_2$, $R_3$ and X each has the same meaning as defined above; and L represents a group capable of being released, for example, a halogen atom, a nitro group, a sulfinyl group or a sulfonyl group.

The method for the synthesis of the coupler of the invention is specifically described with reference to the following synthesis examples.

SYNTHESIS EXAMPLE 1

Synthesis of Coupler (5)

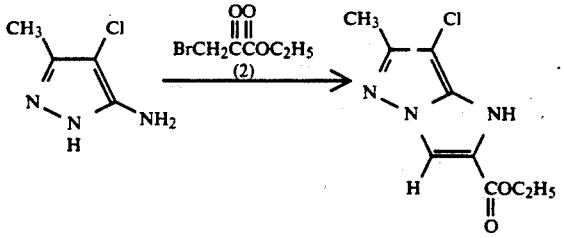

2.76 g (0.02 mol) of 5-amino-4-chloro-3-methylpyrazole (Compound 1) was dissolved in 10 ml of chloroform, the resulting solution was heated to 400° C. and 1.4 ml (0.01 mol) of ethyl α-bromopyruvate was added thereto while stirring. The mixture was stirred for one day at room temperature. The crystals thus deposited were collected and washed with chloroform and then -continued (40)

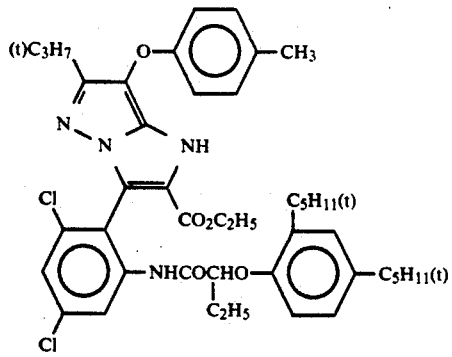

(41)

washed with a mixture of acetonitrile and water (1:1 by volume) to obtain 1.02 g (45%) of Coupler (5).

SYNTHESIS EXAMPLE 2

Synthesis of Coupler (7)

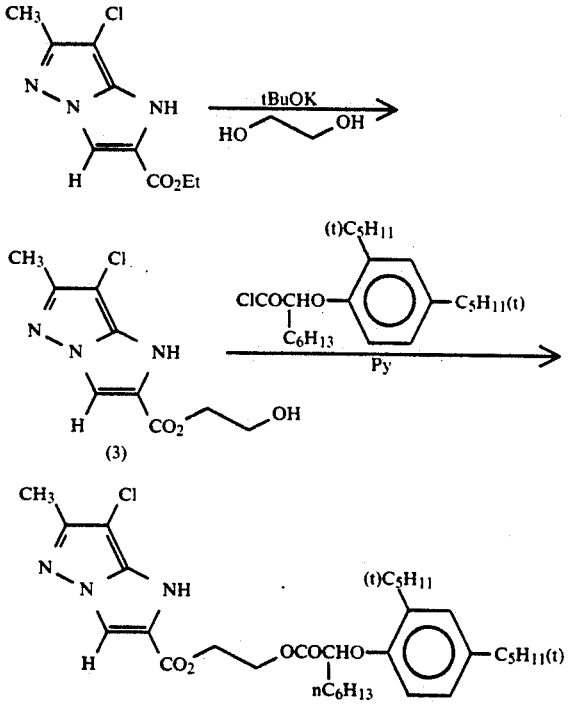

4.55 g of Coupler (5) was dissolved in 100 ml of ethylene glycol and to the resulting solution 4.89 g of potassium tert-butoxide was added. The mixture was then heated at 50° C. while stirring for 7 hours. The reaction solution was neutralized by adding dilute hydrochloric acid and extracted three times with ethyl acetate. The extract was dried with magnesium sulfate and concentrated. The solid thus obtained was recrystallized from acetonitrile to obtain 4.45 g (91% yield) of Compound 3 in total.

2.44 g of Compound 3 was dissolved in 10 ml of N,N-dimethylacetamide and acid chloride was gradually added dropwise to the resulting solution and then 1.62 ml of pyridine was added, followed by stirring at room temperature for 1.5 hours. The reaction mixture was extracted three times with ethyl acetate. The extract was washed twice with a saturated aqueous solution of sodium chloride, dried with magnesium sulfate and concentrated to obtain 11.63 g of a viscous oily product. The product was purified by silica gel column chromatography (hexane and ethyl acetate =6:1 by volume) to obtain 5.86 g (97% yield) of Coupler (7).

The imidazopyrazole type couplers according to the present invention do not have the undesirable interaction with silver which is observed with pyrazolotriazole type couplers, and as a result they are excellent couplers having good color reproducibility, sensitivity and color density.

By using the couplers according to the present invention, it is possible to design silver halide color photographic materials having sufficiently high sensitivity, gradation and color density even upon rapid processing.

The present invention is explained in greater detail with reference to the following example, but the present invention should not be construed as being limited thereto.

EXAMPLE 1

1.0 mmol of Coupler (5) or (7) according to the present invention or Comparative Coupler (M-1) shown below was dissolved in 10 ml of ethanol. 1.2 mmol of 4-[N-ethyl-N-(2-methanesulfonamidoethyl)]amino-2-methylaniline mono sulfate as a color developing agent was added to each of the resulting solutions and then a solution containing 12.0 mmol of anhydrous sodium carbonate dissolved in 5 ml of water was added thereto, followed by stirring at room temperature. A solution containing 1.2 mmol of potassium persulfate dissolved in 10 ml of water was gradually added dropwise to the mixture. After thoroughly stirring at room temperature for one hour, the mixture was extracted by adding 50 ml of ethyl acetate and 30 ml of water. The ethyl acetate layer was thoroughly washed with a saturated aqueous solution of sodium chloride, and the solvent was removed. The residue was purified by silica gel column chromatography.

The resulting azomethine dye of Coupler (5) or (7) according to the present invention or Comparative Coupler (M-1) was measured to determine its absorption spectrum in ethyl acetate.

The results are shown in FIG. 1.

Comparative Coupler (M-1):

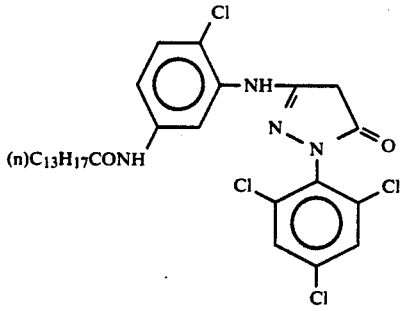

The absorption characteristics of each dye are also shown in Table 1 below. As can be seen from these results, the dye formed from the coupler according to the present invention has a sharply decreasing absorption on the longer wavelength side and a small subsidiary absorption around 400 to 450 nm in comparison with a conventional pyrazolone magenta coupler and is advantageous in view of forming color images.

TABLE 1

| Coupler | Absorption Maximum Wavelength (λ EtOAc max) | Half-Width ($\Delta\frac{1}{2}$) | $S_{+60}$* |
|---|---|---|---|
| Comparative Coupler (M-1) | 526.3 nm | 65.2 nm | 0.117 |
| Coupler (5) | 526.1 nm | 67.1 nm | 0.047 |
| Coupler (7) | 529.5 nm | 66.4 nm | 0.061 |

*$S_{+60}$ means a ratio of absorbance at a point of the absorption maximum plus 60 nm to absorbance at the absorption maximum.

EXAMPLE 2

12.0 g (0.02 mol) of Coupler (7) according to the present invention was dissolved in 12.0 g of dibutyl phthalate as an organic solvent having a high boiling point and in 24 ml of ethyl acetate, and the resulting solution was emulsified and dispersed in 200 g of a 10% by weight aqueous gelatin solution containing 1.5 g of sodium dodecylbenzenesulfonate. An average particle size of the emulsified dispersion was 0.12 μm.

The whole amount of the emulsified dispersion was added to 247 g of silver chlorobromide emulsion (silver content: 70 g per kg of emulsion, silver bromide content: 70 mol %), and the resulting mixture was coated on a triacetate film support having a subbing layer in a silver coating amount of 1.73 g/m$^2$. Onto the emulsion layer was coated a gelatin layer at a dry layer thickness of 1.0 μm to form a protective layer, whereby Sample 2A-1 was prepared. As a gelatin hardener, 1-oxy-3,5-dichloro-s-triazine sodium salt was used.

Samples 2A-2 to 2A-7 were prepared in the same manner as Sample 2A-1 except for replacing the magenta coupler used in Sample 2A-1 with an equimolar amount of the magenta couplers according to the present invention shown in Table 2 below, respectively.

Further, Comparative Samples (2B-1), (2B-2) and (2B-3) were prepared in the same manner as Sample 2A-1 except for replacing the magenta coupler used in Sample 2A-1 with an equimolar amount of Comparative Coupler (M-1) described above and Comparative Couplers (M-3) and (M-4) shown below, respectively.

Comparative Coupler (M-3):

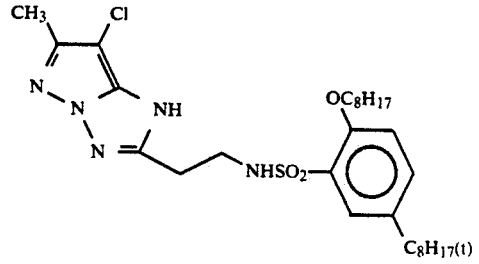

Comparative Coupler (M-4):

-continued

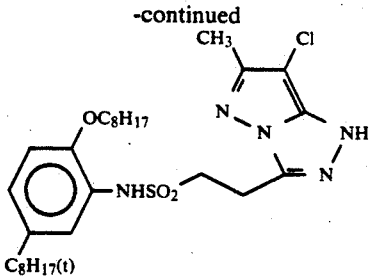

Each sample thus-prepared was subjected to wedge exposure through a three color separation filter for sensitometry using a sensitometer (FWH type, manufactured by Fuji Photo Film Co., Ltd.) equipped with a light source having a color temperature of 3,200° K. The amount of exposure was 25 CMS and the exposure time was 0.1 second.

The exposed sample was processed in an automatic developing machine according to the processing steps shown below.

| Processing Step | Temperature (°C.) | Time |
|---|---|---|
| Color Development | 37 | 3 min. 30 sec. |
| Bleach-Fixing | 33 | 1 min. 30 sec. |
| Washing with Water | 24 to 34 | 3 min. |
| Drying | 70 to 80 | 1 min. |

The composition of each processing solution which was used is illustrated below.

| | |
|---|---|
| Color Developing Solution: | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightening agent (WHITEX 4B manufactured by Sumitomo Chemical Co., Ltd.) | 1.0 g |
| Water to make | 1000 ml |
| pH (25° C.) | 10.25 |
| Bleach-Fixing Solution: | |
| Water | 400 ml |
| Ammonium thiosulfate (70% aqueous solution) | 150 ml |
| Sodium sulfite | 18 g |
| Ammonium iron(III) ethylendiamine-tetraacetate | 55 g |
| Disodium ethylenediamine-tetraacetate | 5 g |
| Water to make | 1000 ml |
| pH (25° C) | 6.70 |

Each of the samples thus processed was subjected to sensitometry. The results obtained are shown in Table 2 below.

TABLE 2

| Sample | Coupler | Sensitivity (s)* | Gradation (Y)** | Maximum Density (Dm) |
|---|---|---|---|---|
| 2A-1 | (7) (Present Invention) | 85 | 2.70 | 2.80 |
| 2A-2 | (2) (Present Invention) | 90 | 2.80 | 2.85 |
| 2A-3 | (3) (Present Invention) | 92 | 2.82 | 2.86 |

TABLE 2-continued

| Sample | Coupler | Sensitivity (s)* | Gradation (Y)** | Maximum Density (Dm) |
|---|---|---|---|---|
| 2A-4 | (13) (Present Invention) | 88 | 2.75 | 2.82 |
| 2A-5 | (28) (Present Invention) | 89 | 2.78 | 2.83 |
| 2A-6 | (34) (Present Invention) | 80 | 2.60 | 2.75 |
| 2A-7 | (38) (Present Invention) | 80 | 2.81 | 2.90 |
| 2B-1 | Comparative Coupler (M-1) | 100 | 2.50 | 2.65 |
| 2B-2 | Comparative Coupler (M-3) | 110 | 2.43 | 2.54 |
| 2B-3 | Comparative Coupler (M-4) | 112 | 2.47 | 2.53 |

*Sensitivity (s) is a value of the exposure amount necessary for providing a density of fog plus 0.5 and shown relatively taking the value of Comparative Sample (2B-1) as 100.

**Gradation (Y) means a slope of a sensitometric curve between a point having a density of 0.5 and a point having a density of 2.5.

From the results shown in Table 2, it can be seen that the magenta couplers according to the present invention exhibit high sensitivity and an excellent color forming property due to the reduced interaction with silver in comparison with the comparative couplers.

EXAMPLE 3

Preparation of Sample 3A-1

A cellulose triacetate film support (thickness: 127 μm) having a subbing layer was coated with each layer having the composition set forth below to prepare a multilayer color photographic light-sensitive material. This photographic material was designated Sample 3A-1. Numerals indicate amounts added per m². It should be noted that the effects of the compounds added are not limited to the uses described.

| | |
|---|---|
| First Layer: Antihalation Layer | |
| Black colloidal silver | 0.25 g |
| Gelatin | 1.9 g |
| Ultraviolet light absorbing agent U-1 | 0.04 g |
| Ultraviolet light absorbing agent U-2 | 0.1 g |
| Ultraviolet light absorbing agent U-3 | 0.1 g |
| Ultraviolet light absorbing agent U-4 | 0.1 g |
| Ultraviolet light absorbing agent U-5 | 0.1 g |
| Ultraviolet light absorbing agent U-6 | 0.1 g |
| Organic solvent having a high boiling point Oil-1 | 0.1 g |
| Second Layer: Intermediate Layer | |
| Gelatin | 0.40 g |
| Compound Cpd-D | 10 mg |
| Organic solvent having a high boiling point Oil-3 | 0.1 g |
| Dye D-4 | 0.4 mg |
| Third Layer: Intermediate Layer | |
| Surface and internal fogged fine grain silver iodobromide emulsion (average grain size: 0.06 μm, coefficient of variation: 18%, AgI content: 1 mol %) | 0.05 g (as silver) |
| Gelatin | 0.4 g |
| Fourth Layer: Low-Speed Red-Sensitive Emulsion Layer | |
| Emulsion A | 0.2 g (as silver) |
| Emulsion B | 0.3 g (as silver) |
| Gelatin | 0.8 g |
| Coupler C-1 | 0.15 g |
| Coupler C-2 | 0.05 g |
| Coupler C-7 | 0.05 g |
| Compound Cpd-D | 10 mg |
| Organic solvent having a high boiling point Oil-1 | 0.1 g |
| Fifth Layer: Medium-Speed Red-Sensitive Emulsion Layer | |

-continued

| | |
|---|---|
| Emulsion B | 0.2 g (as silver) |
| Emulsion C | 0.3 g (as silver) |
| Gelatin | 0.8 g |
| Coupler C-1 | 0.2 g |
| Coupler C-2 | 0.05 g |
| Coupler C-3 | 0.2 g |
| Organic solvent having a high boiling point Oil-2 | 0.1 g |
| Sixth Layer: | |
| High-Speed Red-Sensitive Emulsion Layer | |
| Emulsion D | 0.4 g (as silver) |
| Gelatin | 1.1 g |
| Coupler C-1 | 0.3 g |
| Coupler C-3 | 0.7 g |
| Additive P-1 | 0.1 g |
| Seventh Layer: Intermediate Layer | |
| Gelatin | 0.6 g |
| Additive M3-1 | 0.3 g |
| Color mixing preventing agent Cpd-K | 2.6 mg |
| Ultraviolet light absorbing agent U-1 | 0.1 g |
| Ultraviolet light absorbing agent U-6 | 0.1 g |
| Dye D-1 | 0.02 g |
| Eighth Layer: Intermediate Layer | |
| Surface and internal fogged silver iodobromide emulsion (average grain size: 0.06 μm, coefficient of variation: 16%, AgI content: 0.3 mol %) | 0.02 g (as silver) |
| Gelatin | 1.0 g |
| Additive P-1 | 0.2 g |
| Color mixing preventing agent Cpd-J | 0.1 g |
| Color mixing preventing agent Cpd-A | 0.1 g |
| Ninth Layer: | |
| Low-Speed Green-Sensitive Emulsion Layer | |
| Emulsion E | 0.3 g (as silver) |
| Emulsion F | 0.1 g (as silver) |
| Emulsion G | 0.1 g (as silver) |
| Gelatin | 0.5 g |
| Coupler (7) according to the present invention | 0.25 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| Organic solvent having a high boiling point Oil-1 | 0.1 g |
| Organic solvent having a high boiling point Oil-2 | 0.1 g |
| Tenth Layer: | |
| Medium-Speed Green-Sensitive Emulsion Layer | |
| Emulsion G | 0.3 g (as silver) |
| Emulsion H | 0.1 g (as silver) |
| Gelatin | 0.6 g |
| Coupler (7) according to the present invention | 0.3 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| Organic solvent having a high boiling point Oil-2 | 0.01 g |
| Eleventh Layer: | |
| High-Speed Green-Sensitive Emulsion Layer | |
| Emulsion I | 0.5 g (as silver) |
| Gelatin | 1.0 g |
| Coupler C-4 | 0.3 g |
| Coupler (7) according to the present invention | 0.1 g |
| Compound Cpd-B | 0.08 g |
| Compound Cpd-E | 0.02 g |

-continued

| | |
|---|---|
| Compound Cpd-F | 0.02 g |
| Compound Cpd-G | 0.02 g |
| Compound Cpd-H | 0.02 g |
| Organic solvent having a high boiling point Oil-1 | 0.02 g |
| Organic solvent having a high boiling point Oil-2 | 0.02 g |
| Twelfth Layer: Intermediate Layer | |
| Gelatin | 0.6 g |
| Dye D-1 | 0.1 g |
| Dye D-2 | 0.05 g |
| Dye D-3 | 0.07 g |
| Thirteenth Layer: Yellow Filter Layer | |
| Yellow colloidal silver | 0.1 g (as silver) |
| Gelatin | 1.1 g |
| Color mixing preventing agent Cpd-A | 0.01 g |
| Organic solvent having a high boiling point Oil-1 | 0.01 g |
| Fourteenth Layer: Intermediate Layer | |
| Gelatin | 0.6 g |
| Fifteenth Layer: | |
| Low-Speed Blue-Sensitive Emulsion Layer | |
| Emulsion J | 0 4 g (as silver) |
| Emulsion K | 0.1 g (as silver) |
| Emulsion L | 0.1 g (as silver) |
| Gelatin | 0.8 g |
| Coupler C-5 | 0.6 g |
| Sixteenth Layer: | |
| Medium-Speed Blue-Sensitive Emulsion Layer | |
| Emulsion L | 0.1 g (as silver) |
| Emulsion M | 0.4 g (as silver) |
| Gelatin | 0.9 g |
| Coupler C-5 | 0.3 g |
| Coupler C-6 | 0.3 g |
| Seventeenth Layer: | |
| High-Speed Blue-Sensitive Emulsion Layer | |
| Emulsion N | 0.4 g (as silver) |
| Gelatin | 1.2 g |
| Coupler C-6 | 0.7 g |
| Eighteenth Layer: First Protective Layer | |
| Gelatin | 0.7 g |
| Ultraviolet light absorbing agent U-1 | 0.04 g |
| Ultraviolet light absorbing agent U-2 | 0.01 g |
| Ultraviolet light absorbing agent U-3 | 0.03 g |
| Ultraviolet light absorbing agent U-4 | 0.03 g |
| Ultraviolet light absorbing agent U-5 | 0.05 g |
| Ultraviolet light absorbing agent U-6 | 0.05 g |
| Organic solvent having a high boiling point Oil-1 | 0.02 g |
| Formalin scavenger Cpd-C | 0.2 g |
| Formalin scavenger Cpd-I | 0.4 g |
| Dye D-3 | 0.05 g |
| Nineteenth Layer: Second Protective Layer | |
| Colloidal silver | 0.1 g (as silver) |
| Fine grain silver iodobromide emulsion (average grain size: 0.6 μm, AgI content: 1 mol %) | 0.1 g (as silver) |
| Gelatin | 0.4 g |
| Twentieth Layer: Third Protective Layer | |
| Gelatin | 0.4 g |
| Polymethyl methacrylate (average particle size: 1.5 μm) | 0.1 g |
| Methyl methacrylate-acrylic acid (4:6) copolymer (average particle size: 1.5 μm) | 0.1 g |
| Silicone oil | 0.03 g |
| Surfactant W-1 | 3.0 mg |
| Surfactant W-2 | 0.03 g |

In addition to the above-described components, Additives F-1 to F-8 were added to each of the emulsion layers. Further, Gelatin hardener H-1 and Surfactants W-3 and W-4 for coating and emulsification were added to each layer. Moreover, phenol, 1,2-benzisothiazolin-3-one, 2-phenoxyethanol and phenethyl alcohol were added to each layer as antiseptics and antimolds.

The silver iodobromide emulsions used for the preparation of Sample 3A-1 were as follows.

| Emulsion | Type of Grain | Average Grain Size (μm) | Coefficient of Variation (%) | AgI Content (%) |
|---|---|---|---|---|
| A | Monodispersed tetradecahedral grain | 0.25 | 16 | 3.7 |
| B | Monodispersed cubic internal latent image type grain | 0.30 | 10 | 3.3 |
| C | Monodispersed tetradecahedral grain | 0.30 | 18 | 5.0 |
| D | Monodispersed twin grain | 0.60 | 25 | 2.0 |
| E | Monodispersed cubic grain | 0.17 | 17 | 4.0 |
| F | Monodispersed cubic grain | 0.20 | 16 | 4.0 |
| G | Monodispersed cubic internal latent image type grain | 0.25 | 11 | 3.5 |
| H | Monodispersed cubic internal latent image type grain | 0.30 | 9 | 3.5 |
| I | Monodispersed tabular grain (average aspect ratio: 4.0) | 0.80 | 28 | 1.5 |
| J | Monodispersed tetradecahedral grain | 0.30 | 18 | 4.0 |
| K | Monodispersed tetradecahedral grain | 0.37 | 17 | 4.0 |
| L | Monodispersed cubic internal latent image type grain | 0.46 | 14 | 3.5 |
| M | Monodispersed cubic grain | 0.55 | 13 | 4.0 |
| N | Monodispersed tabular grain (average aspect ratio: 7.0) | 1.00 | 33 | 1.3 |

Spectral sensitization methods for Emulsions A to N were as follows.

| Emulsion | Sensitizing Dye | Amount of Sensitizing Dye (g/mol AgX) | Period of Addition of Sensitizing Dye |
|---|---|---|---|
| A | S-1 | 0.025 | Just after chemical sensitization |
| | S-2 | 0.25 | Just after chemical sensitization |
| B | S-1 | 0.01 | Just after end of grain formation |
| | S-2 | 0.25 | Just after end of grain formation |
| C | S-1 | 0.02 | Just after chemical sensitization |
| | S-2 | 0.25 | Just after chemical sensitization |
| D | S-1 | 0.01 | Just after chemical sensitization |
| | S-2 | 0.10 | Just after chemical sensitization |
| | S-7 | 0.01 | Just after chemical sensitization |
| E | S-3 | 0.5 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after end of grain formation |
| | S-4 | 0.08 | Just after end of grain formation |
| H | S-3 | 0.2 | During grain formation |
| | S-4 | 0.06 | During grain formation |
| I | S-3 | 0.3 | Just before start of chemical sensitization |
| | S-4 | 0.07 | Just before start of chemical sensitization |
| | S-8 | 0.1 | Just before start of chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Just after end of grain formation |
| | S-5 | 0.06 | Just after end of grain formation |
| M | S-6 | 0.15 | Just after chemical sensitization |
| | S-5 | 0.04 | Just after chemical sensitization |
| N | S-6 | 0.22 | Just after end of grain formation |
| | S-5 | 0.06 | Just after end of grain formation |

Chemical formulas or names of the compounds used in Sample 3A-1 are illustrated below.

C-1

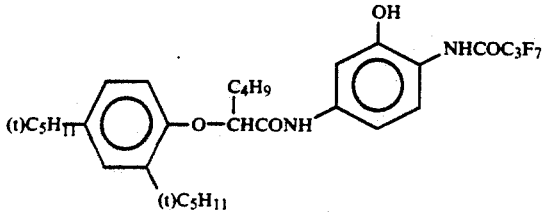

C-2

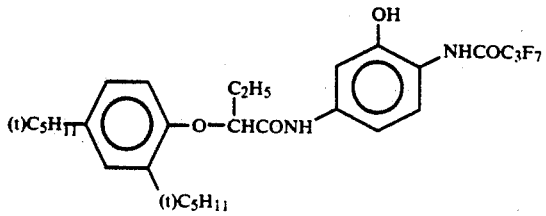

C-3

C-4

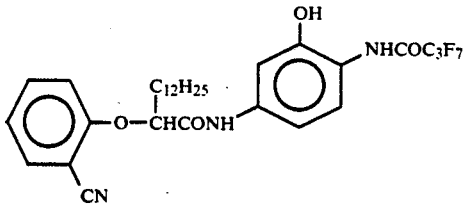
-continued
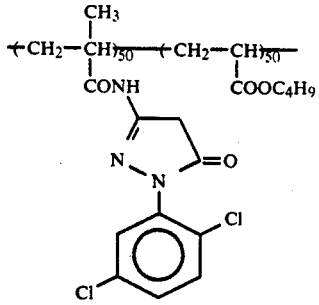
(wt %, average molecular weight: Ca. 25,000)
C-5
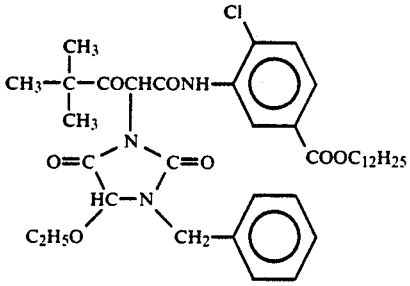
C-6
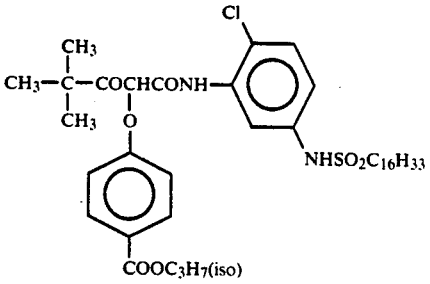
C-7
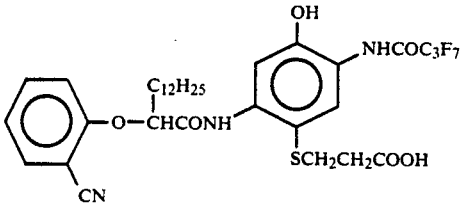
High Boiling Organic Solvent
Oil-1
Dibutyl phthalate
Oil-2
Tricresyl phosphate
Oil-3
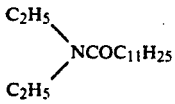
Cpd-A
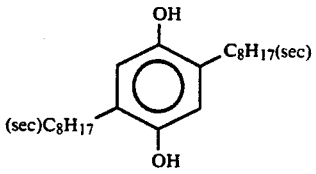
Cpd-B
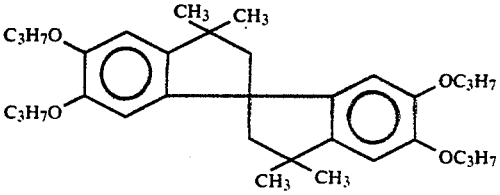
Cpd-C
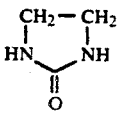
Cpd-D
Cpd-E

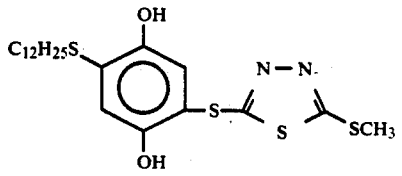
-continued
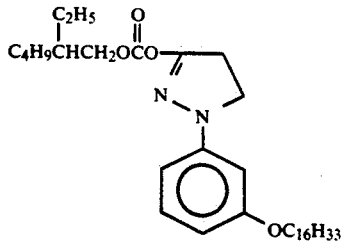
Cpd-F
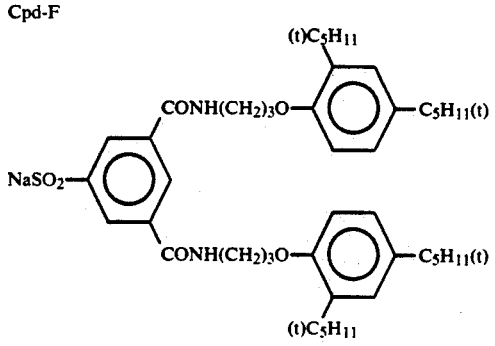
Cpd-G
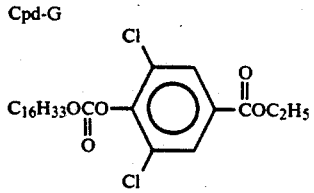
Cpd-H
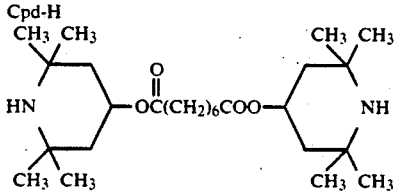
Cpd-I
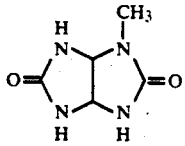
Cpd-J
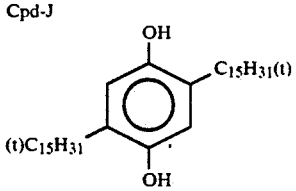
Cpd-K
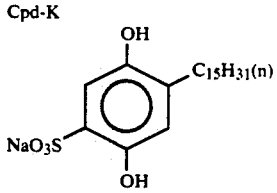
UV Absorbent
U-1
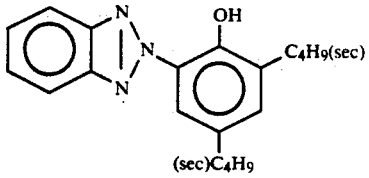
U-2
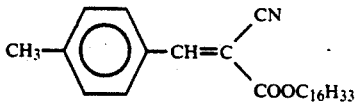
U-3
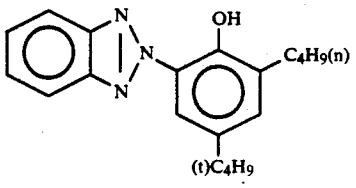
U-4
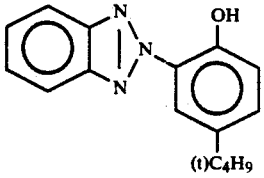
U-5
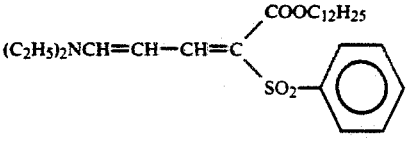
U-6
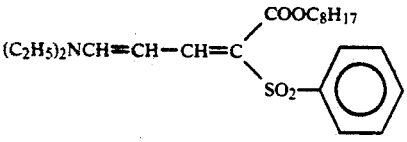
Sensitizing Dye -continued
S-1
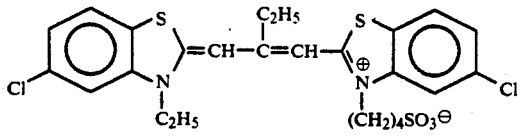
S-2
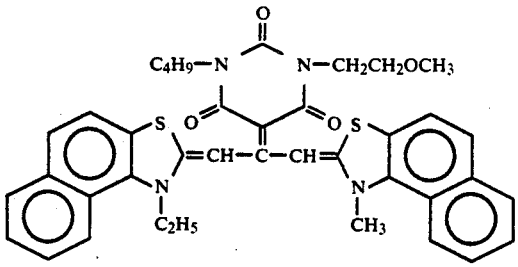
S-3
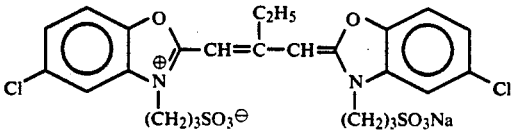
S-4
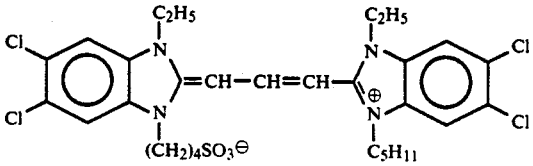
S-5
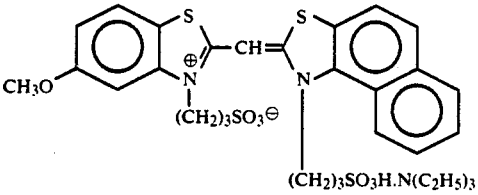
S-6
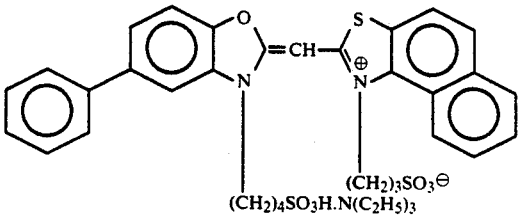
S-7
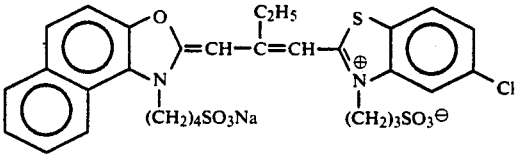
S-8
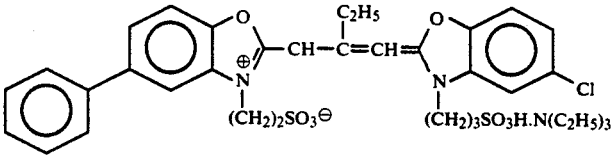
Dye
D-1
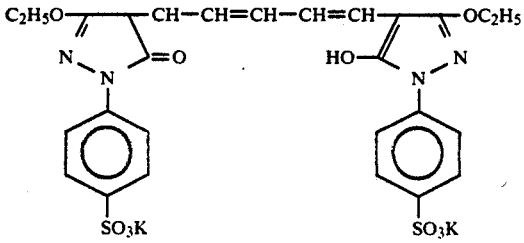
D-2
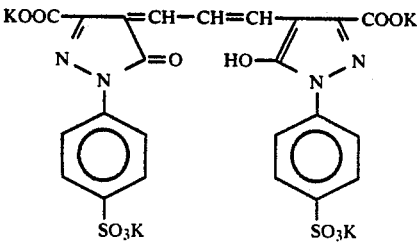
D-3
D-4

-continued
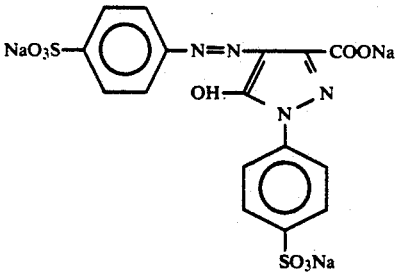
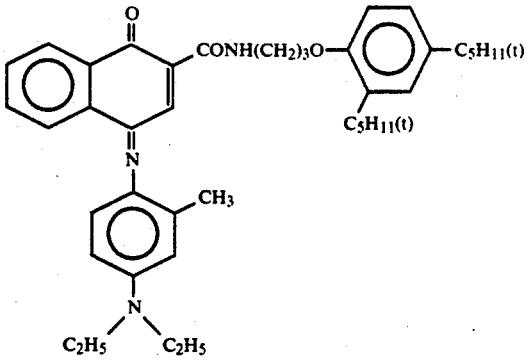
Gelatin Hardening Agent
H-1
$CH_2{=}CH{-}SO_2{-}CH_2{-}CONH{-}CH_2$
$CH_2{=}CH{-}SO_2{-}CH_2{-}CONH{-}CH_2$
Surfactant
W-1
$C_8F_{17}SO_2NHCH_2CH_2CH_2OCH_2CH_2\overset{\oplus}{N}(CH_3)_3$
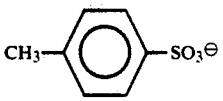
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
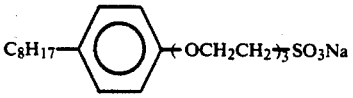
Additives
P-1
$\leftarrow CH_2{-}CH(CONHC_4H_9(t)) \rightarrow_n$
M3-1
$\leftarrow CH_2{-}CH(COOC_4H_9) \rightarrow_n$
F-1
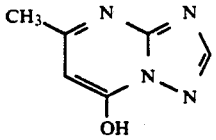
F-2
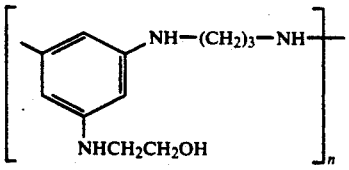
$\cdot HNO_3$
F-3
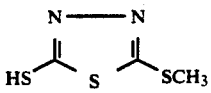
F-4
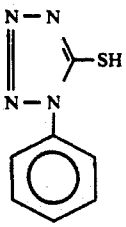
F-5
F-6

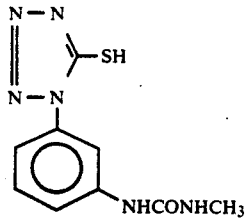

F-7

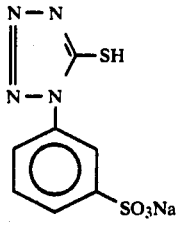

-continued

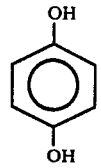

F-8

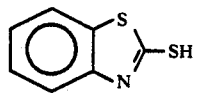

Samples (3A-2) to (3A-7) were prepared in the same manner as described for Sample (3A-1) except that Coupler (7) according to the present invention used in Sample (3A-1) was replaced with an equimolar amount of Couplers (4), (10), (17), (20) and (25) according to the present invention, respectively.

Further, Comparative Samples (3B-1) to (3B-3) were prepared in the same manner as described for Sample (3A-1) except that Coupler (7) according to the present invention used in Sample (3A-1) was replaced with an equimolar amount of Comparative Couplers (M-3) and (M-4) described above and Comparative Coupler (M-5) shown below, respectively.

Comparative Coupler (M-5):

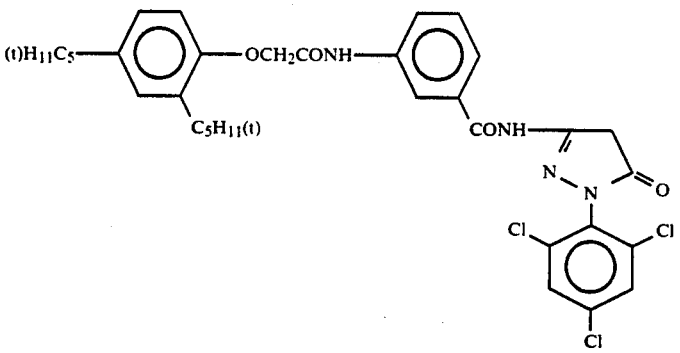

These samples thus-prepared were subjected to exposure for sensitometry and then processed by an automatic developing machine according to the processing steps shown below.

| Processing Step | Time | Temperature (°C.) |
|---|---|---|
| First Development | 6 minutes | 38 |
| Washing with Water | 2 minutes | 38 |
| Reversal | 2 minutes | 38 |
| Color Development | 6 minutes | 38 |
| Controlling | 2 minutes | 38 |
| Bleaching | 6 minutes | 38 |
| Fixing | 4 minutes | 38 |
| Washing with Water | 4 minutes | 38 |
| Stabilizing | 1 minute | room temperature |

Drying

The composition of each processing solution which was used is illustrated below.

| | |
|---|---|
| First Developing Solution: | |
| Water | 700 ml |
| Pentasodium nitrilo-N,N,N-trimethylenephosphonate | 2 g |
| Sodium sulfite | 20 g |
| Hydroquinonemonosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% soln.) | 2 ml |
| Water to make | 100 ml |
| Reversal Solution: | |
| Water | 400 ml |
| Pentasodium nitrilo-N,N,N-trimethylenephosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| Color Developing Solution: | |
| Water | 700 ml |
| Pentasodium nitrilo-N,N,N-trimethylenephosphonate | 3 g |
| Sodium sulfite | 7 g |
| Sodium tertiary phosphate (12 hydrate) | 36 g |

-continued

| | |
|---|---|
| Potassium bromide | 1 g |
| Potassium iodide (0.1% soln.) | 90 ml |
| Sodium hydroxide | 3 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1 g |
| Water to make | 1000 ml |
| Controlling Solution: | |
| Water | 700 ml |
| Sodium sulfite | 12 g |
| Sodium ethylenediaminetetraacetate (dihydrate) | 8 g |
| Thioglycerol | 0.4 ml |
| Glacial acetic acid | 3 ml |
| Water to make | 1000 ml |
| Bleaching Solution: | |
| Water | 800 ml |
| Sodium ethylenediaminetetraacetate (dihydrate) | 2 g |
| Ammonium iron(III) ethylenediaminetetraacetate (dihydrate) | 120 g |
| Potassium bromide | 100 g |
| Water to make | 1000 ml |
| Fixing Solution: | |
| Water | 800 ml |
| Sodium thiosulfate | 80.0 g |
| Sodium sulfite | 5.0 g |
| Sodium bisulfite | 5.0 g |
| Water to make | 1000 ml |
| Stabilizing Solution: | |
| Water | 800 ml |
| Formalin (37 wt %) | 5.0 g |
| Fuji Drywel (surface active agent, manufactured by Fuji Photo Film Co., Ltd.) | 5.0 g |
| Water to make | 1000 ml |

Each of the samples thus processed was subjected to sensitometry. The results obtained are shown in Table 3 below.

TABLE 3

| Sample | Coupler | Gradation (Y)* | Maximum Density (Dm) |
|---|---|---|---|
| 3A-1 | (7) (Present Invention) | 2.65 | 2.70 |
| 3A-2 | (4) (Present Invention) | 2.70 | 2.80 |
| 3A-3 | (10) (Present Invention) | 2.75 | 2.90 |
| 3A-4 | (17) (Present Invention) | 2.68 | 2.79 |
| 3A-5 | (20) (Present Invention) | 2.66 | 2.71 |
| 3A-6 | (25) (Present Invention) | 2.69 | 2.82 |
| 3B-1 | Comparative Coupler (M-3) | 2.48 | 2.66 |
| 3B-2 | Comparative Coupler (M-4) | 2.40 | 2.53 |
| 3B-3 | Comparative Coupler (M-5) | 2.46 | 2.52 |

*Gradation (Y) means a slope of a sensitometric curve between a point having a density of 0.5 and a point having a density of 2.5.

From the results shown in Table 3, it can be seen that the magenta couplers according to the present invention exhibit excellent color forming property due to the reduced interaction with silver in comparison with the comparative couplers.

EXAMPLE 4

A paper support, both surfaces of which were laminated with polyethylene, was subjected to corona discharge treatment and provided with a gelatin subbing layer containing sodium dodecylbenzenesulfonate, and then coated with the photographic constituting layers as shown below to prepare a multilayer color printing paper, which is denoted as Sample (4A-1). The coating solutions were prepared in the following manner.

Preparation of Coating Solution for First Layer 19. 1 g of Yellow coupler (ExY) , 4. 4 g of Color image stabilizer (Cpd-1) and 0.7 g of Color image stabilizer (Cpd-7) were dissolved in 27.2 ml of ethyl acetate, 4.1 g of Solvent (Solv-3) and 4.1 g of Solvent (Solv-7), and the resulting solution was emulsified and dispersed in 185 ml of a 10% aqueous gelatin solution containing 8 ml of a 10% aqueous solution of sodium dodecylbenzenesulfonate to prepare Emulsified Dispersion A. Separately, Silver Chlorobromide Emulsion A (cubic grains; a mixture of large grain size emulsion (average grain size of 0.88 μm) and a small grain size emulsion (average grain size of 0.70 μm) in 3:7 by molar ratio of silver; coefficient of variation of grain size: 0.08 and 0.10, respectively; 0.3 mol % silver bromide based on the whole of grains being localized at a part of the surface of grains respectively) was prepared. Blue-Sensitive Sensitizing Dyes A and B shown below were each added to the emulsion in an amount of $2.0\times10^{-4}$ mol per mol of silver in the case of the large grain size emulsion and in an amount of $2.5\times10^{-4}$ mol per mol of silver in the case of the small grain size emulsion. The emulsion was chemically ripened by adding a sulfur sensitizer and a gold sensitizer. Emulsified Dispersion A described above was mixed with Silver Chlorobromide Emulsion A, with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

Further, Cpd-10 and Cpd-11 were added to each layer in total amounts of 25.0 mg/m² and 50.0 mg/m² respectively.

The following spectral sensitizing dyes were added to the silver chlorobromide emulsions in the light-sensitive emulsion layers respectively.

Sensitizing Dye A for Blue-Sensitive Emulsion Layer:

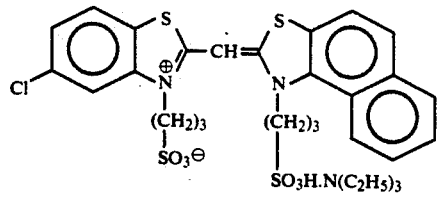

and

Sensitizing Dye B for Blue-Sensitive Emulsion Layer:

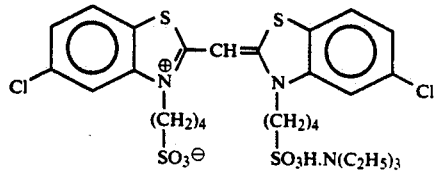

(Amount added: $2.0\times10^{-4}$ mol per mol of silver halide of each were added in the large grain size emulsion and $2.5\times10^{-4}$ mol per mol of silver halide of each were added in the small grain size emulsion)

Sensitizing Dye C for Green-Sensitive Emulsion Layer:

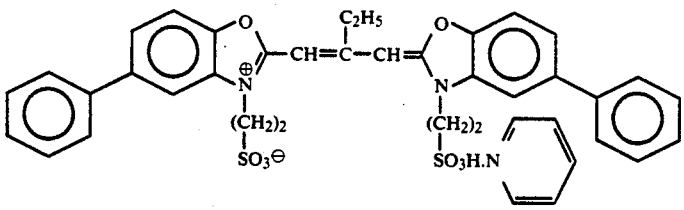

(Amount added: $4.0\times10^{-4}$ mol per mol of silver halide in the large grain size emulsion and $5.6\times10^{-4}$ mol per mol of silver halide in the small grain size emulsion) and Sensitizing Dye D for Green-Sensitive Emulsion Layer:

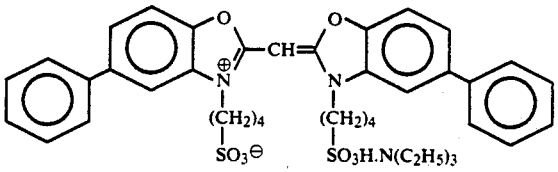

(Amount added: $7.0\times10^{-5}$ mol per mol of silver halide in the large grain size emulsion and $1.0\times10^{-5}$ mol per mol of silver halide in the small grain size emulsion)

Sensitizing Dye E for Red-Sensitive Emulsion Layer:

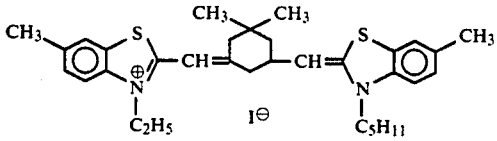

(Amount added: $0.9\times10^{-4}$ mol per mol of silver halide in the large grain size emulsion and $1.1\times10^{-4}$ mol per mol of silver halide in the small grain size emulsion)

To the red-sensitive emulsion layer was added the compound shown below in an amount of $2.6\times10^{-3}$ mol per mol of silver halide.

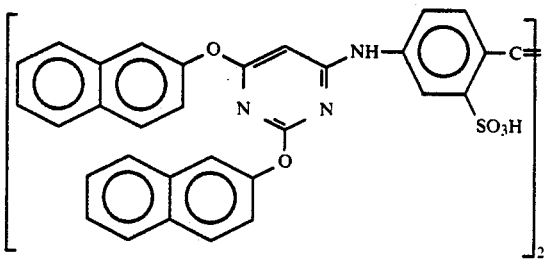

To the blue-sensitive emulsion layer, green-sensitive emulsion layer and red-sensitive emulsion layer were added 1-(5-methylureidophenyl)-5-mercapto-tetrazole in amounts of $8.5\times10^{-5}$ mol, $7.7\times10^{-4}$ mol and $2.5\times10^{-4}$ mol per mol of silver halide, respectively.

Further, to the blue-sensitive emulsion layer and green-sensitive emulsion layer were added 4-hydroxy-6-methyl-1,3,3a,7-tetraazaindene in amounts of $1\times10^{-4}$ mol and $2\times10^{-4}$ mol per mol of silver halide, respectively.

Moreover, in order to prevent irradiation, the following dyes were added to the emulsion layers. The coating amounts thereof are shown in parentheses.

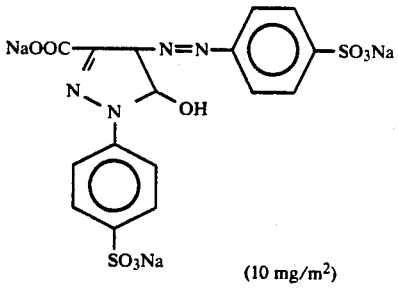

(10 mg/m²)

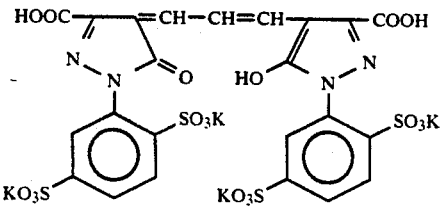

(10 mg/m²)

-continued

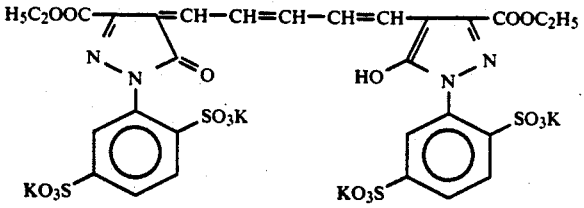

(40 mg/m²)

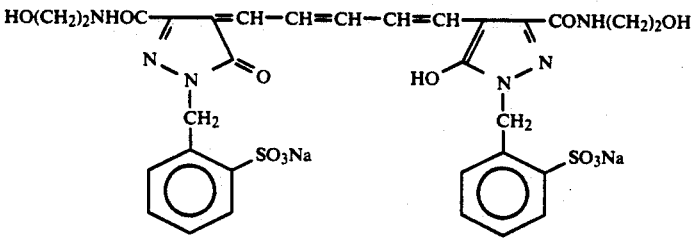

(20 mg/m²)

Layer Construction

The composition of each layer is shown below. The numerical values denote the coating amounts of components in the unit of g/m². The coating amount of silver halide emulsion is indicated in terms of the silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver Chlorobromide Emulsion A described above | 0.30 |
| | Gélatin | 1.86 |
| | Yellow coupler (ExY) | 0.82 |
| | Color image stabilizer (Cpd-1) | 0.19 |
| | Solvent (Solv-3) | 0.18 |
| | Solvent (Solv-7) | 0.18 |
| | Color image stabilizer (Cpd-7) | 0.06 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-sensitive layer) | Silver chlorobromide emulsion (cubic grains, mixture of large grain size emulsion (average grain size of 0.55 μm) and small grain size emulsion (average grain size of 0.39 μm) in 1:3 by molar ratio of silver, coefficient of variation of grain size: 0.10 and 0.08, respectively, 0.8 mol % silver bromide based on the whole of grains being localized at a part of the surface of grains respectively) | 0.12 |
| | Gelatin | 1.24 |
| | Coupler (7) acording to the present invention | 0.23 |
| | Color image stabilizer (Cpd-2) | 0.03 |
| | Color image stabilizer (Cpd-3) | 0.16 |
| | Color image stabilizer (Cpd-4) | 0.02 |

-continued

| | | |
|---|---|---|
| | Color image stabilizer (Cpd-9) | 0.02 |
| | Solvent (Solv-2) | 0.40 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of large grain size emulsion (average grain size of 0.58 μm) and small grain size emulsion (average grain size of 0.45 μm) in 1:4 by molar ratio of silver, coefficient of variation of grain size: 0.09 and 0.11, respectively, 0.6 mol % silver bromide based on the whole of grains being localized at a part of the surface of grains respectively) | 0.23 |
| | Gelatin | 1.34 |
| | Cyan coupler (ExC) | 0.32 |
| | Color image stabilizer (Cpd-2) | 0.03 |
| | Color image stabilizer (Cpd-4) | 0.02 |
| | Color image stabilizer (Cpd-6) | 0.18 |
| | Color image stabilizer (Cpd-7) | 0.40 |
| | Color image stabilizer (Cpd-8) | 0.05 |
| | Solvent (Solv-6) | 0.14 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

Chemical formulas or names of the compounds used in Sample 4A-1 are illustrated below.

Yellow coupler (ExY)

-continued
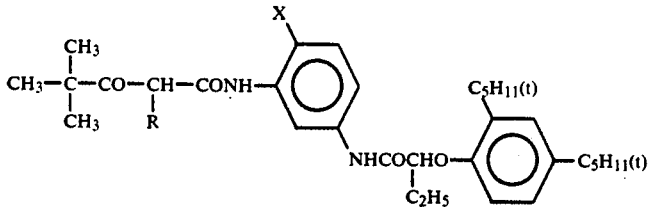
A mixture of the following couplers in a molar ratio of 1:1.
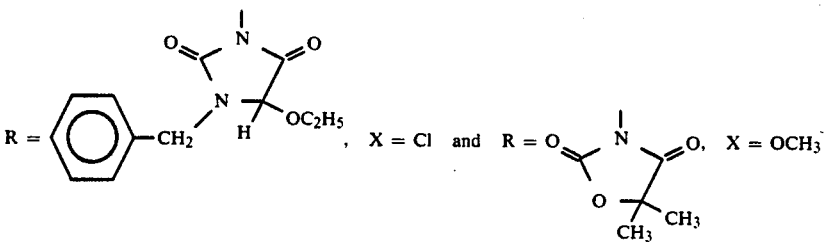
Cyan Coupler (ExC)
A mixture of the following couplers in a molar ratio of 1:1.
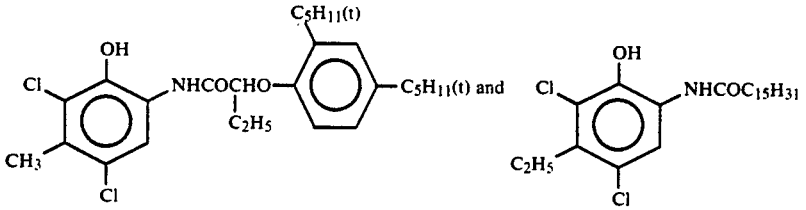
Color Image Stabilizer (Cpd-1)
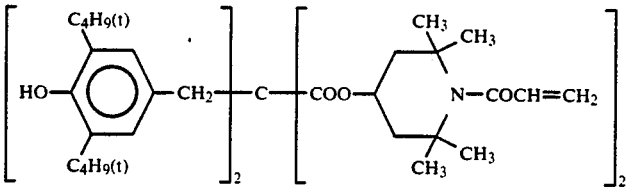
Color Image Stabilizer (Cpd-2)
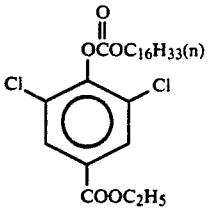
Color Image Stabilizer (Cpd-3)
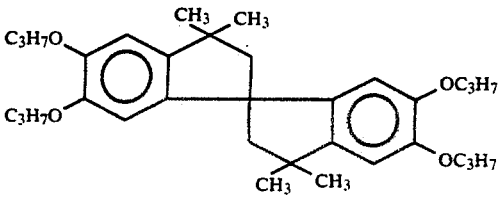
Color Image Stabilizer (Cpd-4)

-continued

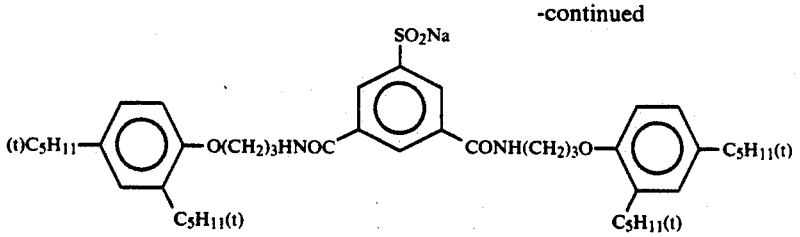

Color Mixing Preventing Agent (Cpd-5)

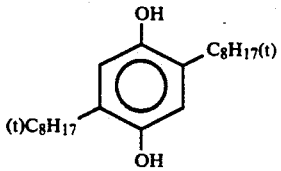

Color Image Stabilizer (Cpd-6)

A mixture of the following agents in weight ratio of 2:4:4.

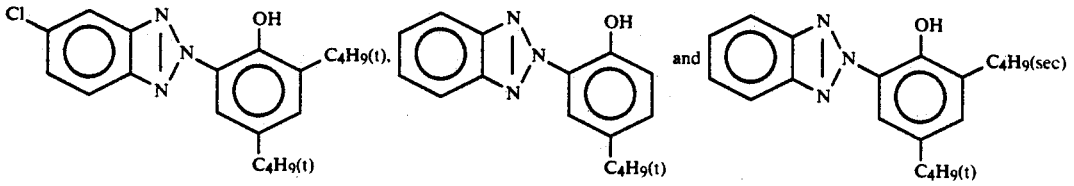

Color Image Stabilizer (Cpd-7)

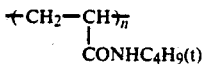

(average molecular weight 60,000)

Color Image Stabilizer (Cpd-8)

A mixture of the following agents in a weight ratio of 1:1.

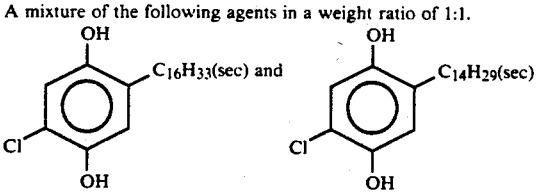

Color Image Stabilizer (Cpd-9)

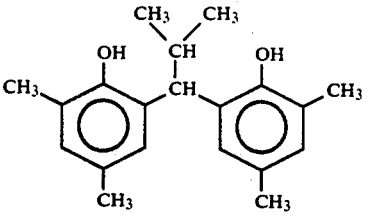

Antiseptic (Cpd-10):

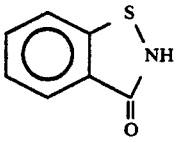

Antiseptic (Cpd-11):

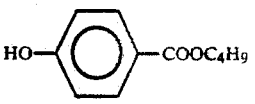

Ultraviolet light Absorbing agent (Cpd-6)

A mixture of the following agents in a weight ratio of 4:2:4.

-continued

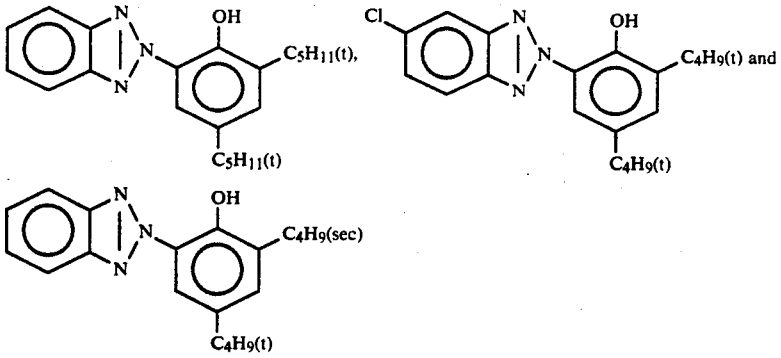

Solvent (Solv-1)

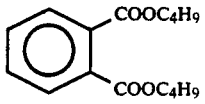

Solvent (Solv-2)

A mixture of the following solvents in a volume ratio of 1:1.

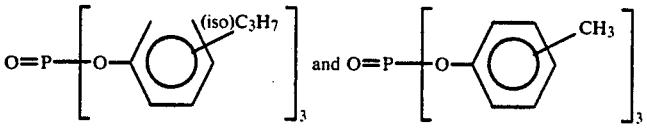

Solvent (Solv-3)

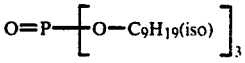

Solvent (Solv-4)

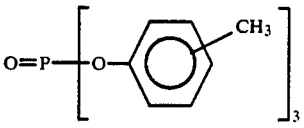

Solvent (Solv-5)

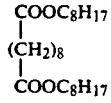

Solvent (Solv-6)

A mixture of the following solvents in a volume ratio of 8:2.

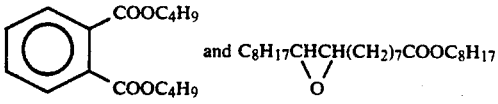

Solvent (Solv-7)

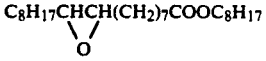

Samples (4A-2) to (4A-7) were prepared in the same manner as described for Sample (4A-1) except that Coupler (7) according to the present invention used in Sample (4A-1) was replaced with an equimolar amount of Couplers (9), (11), (15), (19), (33) and (40) according to the present invention, respectively.

Further, comparative Samples (4B-1) to (4B-3) were prepared in the same manner as described for Sample (4A-1) except that Coupler (7) according to the present invention used in Sample (4A-1) was replaced with an equimolar amount of Comparative Couplers (M-1), (M-3) and (M-4) described above, respectively.

Each sample thus-prepared was subjected to wedge exposure through a three color separating filter for sensitometry using a sensitometer (FWE type, manufactured by Fuji Photo Film Co., Ltd.) equipped with a light source having a color temperature of 3,200° K. The amount of exposure was 250 CMS and the exposure time was 0.1 second.

The exposed sample was subjected to a continuous processing (running test) by a paper processor according to the processing steps described below until the amount of replenishment of color development reached the twice volume of the tank capacity of color development.

| Processing Step | Temperature (°C.) | Time | Amount of* Replenishment (ml) | Tank capacity (l) |
|---|---|---|---|---|
| Color Development | 35 | 45 sec. | 161 | 17 |
| Bleach-Fixing | 30–35 | 45 sec. | 215 | 17 |
| Rinse (1) | 30–35 | 20 sec. | — | 10 |
| Rinse (2) | 30–35 | 20 sec. | — | 10 |
| Rinse (3) | 30–35 | 20 sec. | 350 | 10 |
| Drying | 70–80 | 60 sec. | | |

*The amount of replenishment is per $m^2$ of photographic light-sensitive material The rinse steps were conducted using a three-tank countercurrent system from Rinse (3) to Rinse (1).

The composition of each processing solution used is illustrated below.

| | Tank Solution | Replenisher |
|---|---|---|
| Color Developing Solution: | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| N,N-Di(sulfoethyl)hydroxylamine monosodium salt | 4.0 g | 5.0 g |
| Fluorescent brightening agent (WHITEX 4B manufactured by Sumitomo Chemical Co., Ltd.) | 1.0 g | 2.0 g |
| Water to make | 1000 ml | 1000 ml |
| pH (at 25° C.) | 10.05 | 10.45 |
| Bleach-Fixing Solution: (both tank solution and replenisher) | | |
| Water | 400 ml | |
| Ammonium thiosulfate (70%) | 100 ml | |
| Sodium sulfite | 17 g | |
| Ammonium Iron(III) ethylenediaminetetraacetate | 55 g | |
| Disodium ethylenediaminetetraacetate | 5 g | |
| Ammonium bromide | 40 g | |
| Water to make | 1000 ml | |
| pH (at 25° C.) | 6.0 | |

Rinse Solution: (both tank solution and replenisher)

Ion-exchanged water (calcium and magnesium contents: not more than 3 ppm respectively)

Each of the samples thus processed was subjected to sensitometry. The results obtained are shown in Table 4 below.

TABLE 4

| Sample | Coupler | Sensitivity (s)* | Gradation (Y)** | Maximum Density (Dm) |
|---|---|---|---|---|
| 4A-1 | (7) (Present Invention) | 90 | 2.74 | 2.85 |
| 4A-2 | (9) (Present Invention) | 93 | 2.70 | 2.80 |
| 4A-3 | (11) (Present Invention) | 91 | 2.73 | 2.82 |
| 4A-4 | (15) (Present Invention) | 90 | 2.75 | 2.85 |
| 4A-5 | (19) (Present Invention) | 85 | 2.80 | 2.90 |
| 4A-6 | (33) (Present Invention) | 87 | 2.78 | 2.88 |
| 4A-7 | (40) (Present Invention) | 85 | 2.82 | 2.92 |
| 4B-1 | Comparative Coupler (M-1) | 100 | 2.57 | 2.62 |
| 4B-2 | Comparative Coupler (M-3) | 110 | 2.42 | 2.50 |
| 4B-3 | Comparative Coupler (M-4) | 113 | 2.45 | 2.49 |

*Sensitivity (s) is a value of the exposure amount necessary for providing a density of fog plus 0.5 and shown relatively taking the value of Comparative Sample (4B-1) as 100.

**Gradation (Y) means a slope of a sensitometric curve between a point having a density of 0.5 and a point having a density of 2.5.

From the results shown in Table 4, it can be seen that the magenta couplers according to the present invention exhibit high sensitivity and excellent color forming property due to the reduced interaction with silver in comparison with the comparative couplers.

EXAMPLE 5

On a cellulose triacetate film support provided with a subbing layer was coated each layer having the composition set forth below to prepare a multilayer color photographic light-sensitive material which was designated Sample 5A-1.

With respect to the compositions of the layers, the coating amounts of silver halide and colloidal silver are shown by $g/m^2$ units in terms of silver, the coating amounts of couplers, additives and gelatin are shown by $g/m^2$ units, and the coating amounts of sensitizing dyes are shown by mol number per mol of silver halide present in the same layer.

| | |
|---|---|
| First Layer: Antihalation Layer | |
| Black colloidal silver | 0.15 |
| Gelatin | 1.90 |
| ExM-8 | $2.0 \times 10^{-2}$ |
| Second Layer: Intermediate Layer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv 5-2 | $7.0 \times 10^{-2}$ |
| Third Layer: Low-Speed Red-Sensitive Emulsion Layer | |
| Silver iodobromide emulsion (AgI: 2 mol %, internal high AgI type, diameter corresponding to sphere: 0.3 μm, coefficient of variation of diameter corresponding to sphere: 29%, mixture of regular and twin grains, diameter/thickness ratio: 2.5) | 0.50 (as silver) |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | $3.0 \times 10^{-2}$ |
| Solv 5-1 | $7.0 \times 10^{-3}$ |
| Fourth Layer: Medium-Speed Red-Sensitive Emulsion Layer | |
| Silver iodobromide emulsion (AgI: 4 mol %, internal high | 0.85 (as silver) |

-continued

| | |
|---|---|
| AgI type, diameter corresponding to sphere: 0.55 μm, coefficient of variation of diameter corresponding to sphere: 20%, mixture of regular and twin grains, diameter/thickness ratio: 1.0) | |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-2 | $8.0 \times 10^{-2}$ |
| ExC-3 | 0.33 |
| ExY-13 | $2.0 \times 10^{-2}$ |
| ExY-14 | $1.0 \times 10^{-2}$ |
| Cpd 5-10 | $1.0 \times 10^{-4}$ |
| Solv 5-1 | 0.10 |
| Fifth Layer: | |
| High-Speed Red-sensitive Emulsion Layer | |
| Silver iodobromide emulsion (AgI: 10 mol %, internal high AgI type, diameter corresponding to sphere: 0.7 μm, coefficient of variation of diameter corresponding to sphere: 30%, mixture of regular and twin grains, diameter/thickness ratio: 2.0) | 0.70 (as silver) |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| Solv 5-1 | 0.15 |
| Solv 5-2 | $8.0 \times 10^{-2}$ |
| Sixth Layer: Intermediate Layer | |
| Gelatin | 1.10 |
| P-2 | 0.17 |
| Cpd 5-1 | 0.10 |
| Cpd 5-4 | 0.17 |
| Solv 5-1 | $5.0 \times 10^{-2}$ |
| Seventh Layer: | |
| Low-Speed Green-Sensitive Emulsion Layer | |
| Silver iodobromide emulsion (AgI: 2 mol %, internal high AgI type, diameter corresponding to sphere: 0.3 μm, coefficient of variation of diameter corresponding to sphere: 28%, mixture of regular and twin grains, diameter/thickness ratio: 2.5) | 0.30 (as silver) |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-8 | $3.0 \times 10^{-2}$ |
| Coupler (7) according to the present invention | 0.20 |
| ExY-13 | $3.0 \times 10^{-2}$ |
| Cpd-11 | $7.0 \times 10^{-3}$ |
| Solv-1 | 0.20 |
| Eighth Layer: | |
| Medium-Speed Green-Sensitive Emulsion Layer | |
| Silver iodobromide emulsion (AgI: 4 mol %, internal high AgI type, diameter corresponding to sphere: 0.55 μm, coefficient of variation of diameter corresponding to sphere: 20%, mixture of regular and twin grains, diameter/thickness ratio: 4.0) | 0.70 (as silver) |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-8 | $3.0 \times 10^{-2}$ |
| Coupler (7) according to the present invention | 0.25 |
| ExM-10 | $1.5 \times 10^{-2}$ |
| ExY-13 | $4.0 \times 10^{-2}$ |
| Cpd 5-11 | $9.0 \times 10^{-3}$ |
| Solv 5-1 | 0.20 |
| Ninth Layer: | |
| High-Speed Green-Sensitive Emulsion Layer | |

-continued

| | |
|---|---|
| Silver iodobromide emulsion (AgI: 10 mol %, internal high AgI type, diameter corresponding to sphere: 0.7 μm, coefficient of variation of diameter corresponding to sphere: 30%, mixture of regular and twin grains, diameter/thickness ratio: 2.0) | 0.50 (as silver) |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-8 | $2.0 \times 10^{-2}$ |
| Coupler (7) according to the present invention | $8.0 \times 10^{-2}$ |
| Cpd 5-2 | $1.0 \times 10^{-2}$ |
| Cpd 5-9 | $2.0 \times 10^{-4}$ |
| Cpd 5-10 | $2.0 \times 10^{-4}$ |
| Solv 5-1 | 0.20 |
| Solv 5-2 | $5.0 \times 10^{-2}$ |
| Tenth Layer: Yellow Filter Layer | |
| Gelatin | 0.90 |
| Yellow colloidal silver | $5.0 \times 10^{-2}$ |
| Cpd 5-1 | 0.20 |
| Solv 5 1 | 0.15 |
| Eleventh Layer: | |
| Low-Speed Blue-sensitive Emulsion Layer | |
| Silver iodobromide emulsion (AgI: 4 mol %, internal high AgI type, diameter corresponding to sphere: 0.5 μm, coefficient of variation of diameter corresponding to sphere: 15%, octahedral grains) | 0.40 (as silver) |
| Gelatin | 1.00 |
| ExS-8 | $2.0 \times 10^{-2}$ |
| ExY-13 | $9.0 \times 10^{-2}$ |
| ExY-15 | 0.90 |
| Cod 5-2 | $1.0 \times 10^{-2}$ |
| Solv 5-1 | 0.30 |
| Twelfth Layer: | |
| High-Speed Blue-sensitive Emulsion Layer | |
| Silver iodobromide emulsion (AgI: 10 mol %, internal high AgI type, diameter corresponding to sphere: 1.3 μm, coefficient of variation of diameter corresponding to sphere: 25%, mixture of regular and twin grains, diameter/thickness ratio: 4.5) | 0.50 (as silver) |
| Gelatin | 0.60 |
| ExS-8 | $1.0 \times 10^{-4}$ |
| ExY-15 | 0.12 |
| Cod 5-2 | $1.0 \times 10^{-3}$ |
| Solv 5-1 | $4.0 \times 10^{-2}$ |
| Thirteenth Layer: First Protective Layer | |
| Fine grain silver iodobromide (AgI: 1 mol %, average grain size: 0.07 μm) | 0.20 |
| Gelatin | 0.80 |
| UV-2 | 0.10 |
| UV-3 | 0.10 |
| UV-4 | 0.20 |
| Solv 5-3 | $4.0 \times 10^{-2}$ |
| P5-2 | $9.0 \times 10^{-2}$ |
| Fourteenth Layer: Second Protective Layer | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Further, Cpd 5-3, Cpd 5-5, Cpd 5-6, Cpd 5-7, Cpd 5-8, P5-1, W5-1, W5-2 and W5-3 were added in order to improve preservability, processing property, pressure resistibility, antimold and antibacterial action, antistatic property and coating property.

Moreover, n-butyl-p-hydroxybenzoate was added. In addition, B-4, F5-1, F5-4, F5-5, F5-6, F5-7, F5-8, F5-9, F5-10, F5-11, F5-13, iron salt, lead salt, gold salt, platinum salt, iridium salt and sodium salt were incorporated.

Chemical formulas or the names of the compounds used in Sample 5A-1 are illustrated below.
UV-1
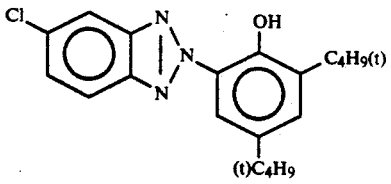
UV-2
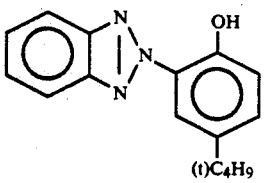
UV-3
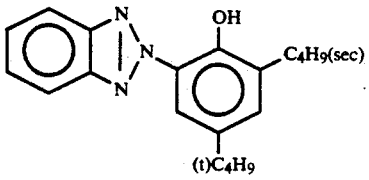
UV-4
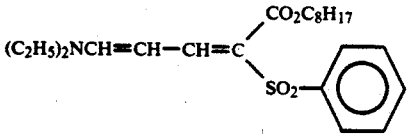
Solv 5-1
Tricresyl phosphate
Solv 5-2
Dibutyl phthalate
Solv 5-3
Tri(2-ethylhexyl) phosphate
ExF-1
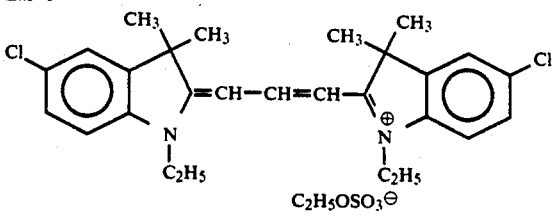
ExC-2
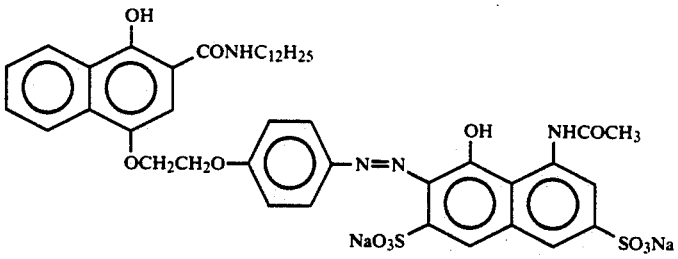
ExC-3
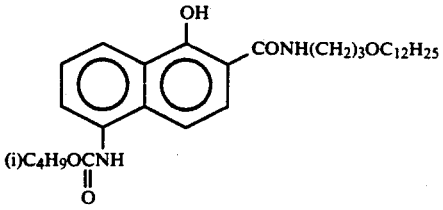
ExC-4
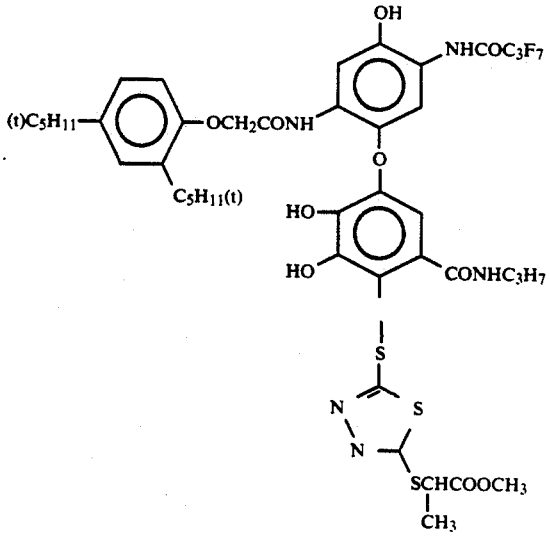
ExC-5

-continued
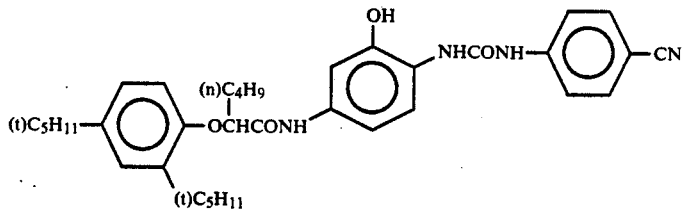
ExC-6
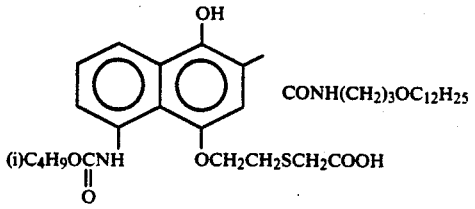
ExM-8
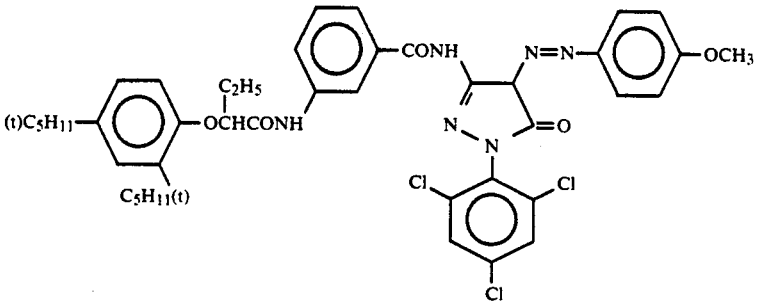
ExM-10
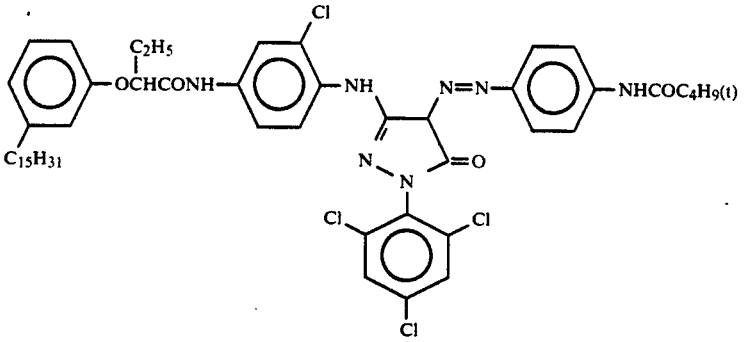
Exy-13
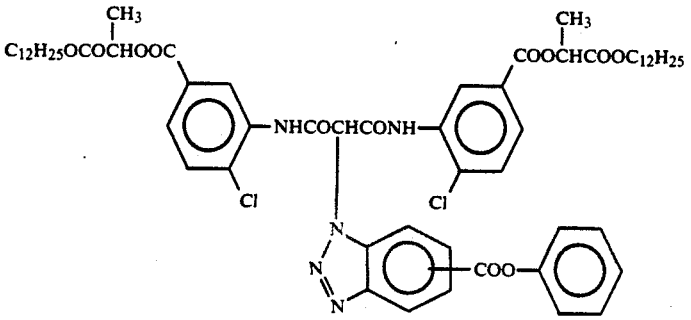
ExY-14

-continued
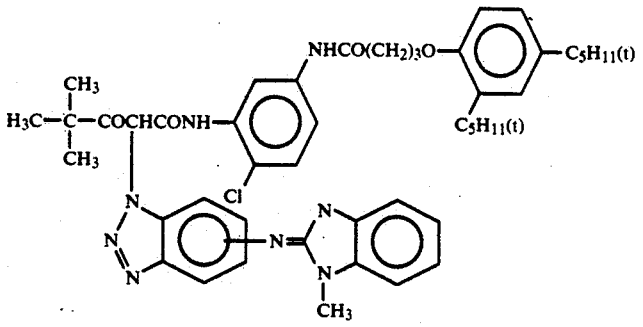
ExY-15
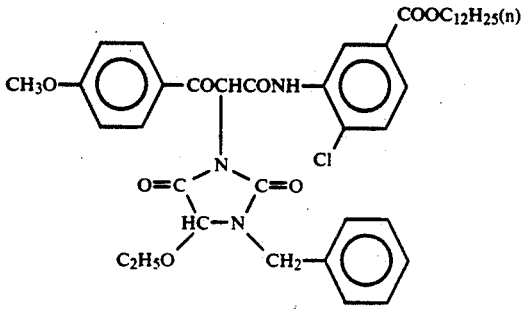
Cpd5-1
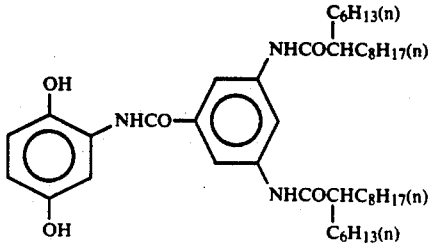
Cpd5-2
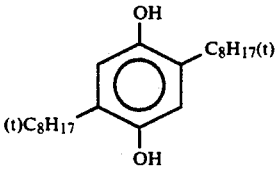
Cpd5-3
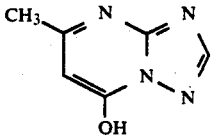
Cpd5-4
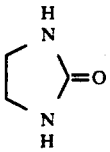
Cpd5-5
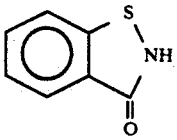
Cpd5-6
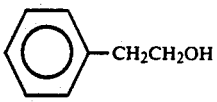
Cpd5-7
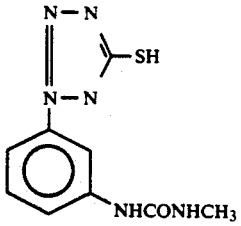
Cpd5-8
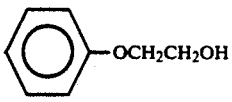
Cpd5-9
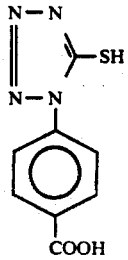
Cpd5-10
Cpd5-11

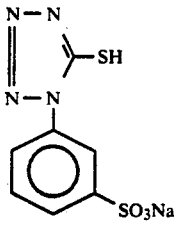
-continued
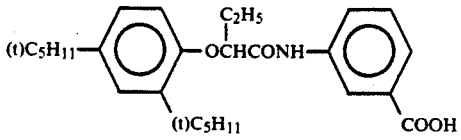
ExS-1
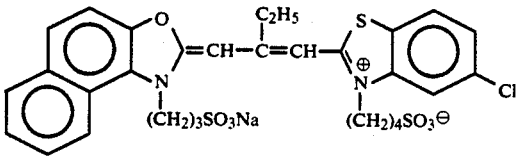
ExS-2
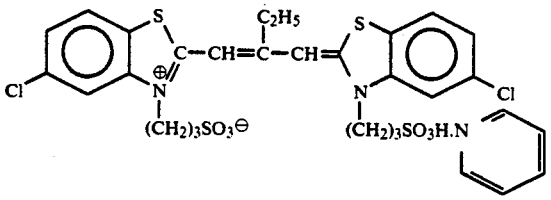
ExS-3
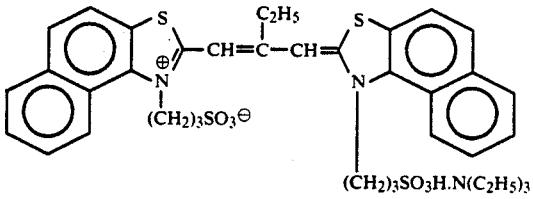
ExS-4
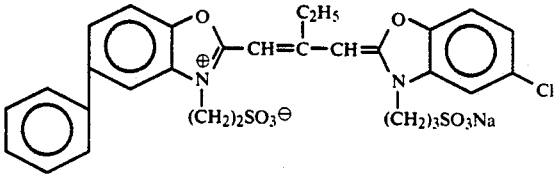
ExS-5
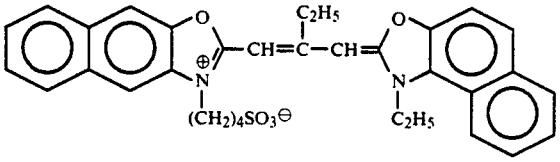
ExS-6
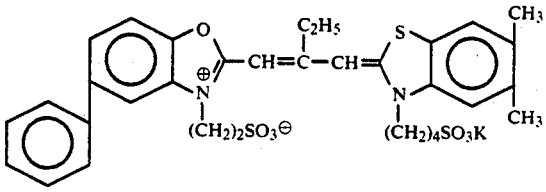
ExS-7
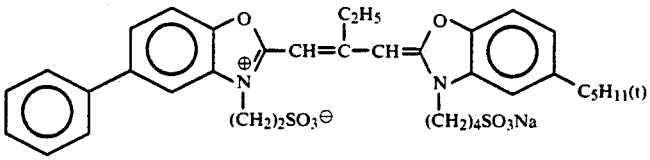
ExS-8
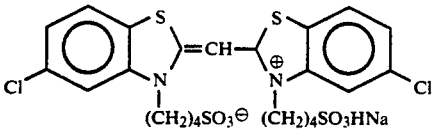
B-4
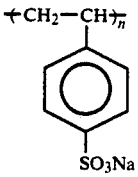
Average molecular weight: 750,000
H-1
$CH_2{=}CH{-}SO_2{-}CH_2{-}CONH{-}CH_2$
$CH_2{=}CH{-}SO_2{-}CH_2{-}CONH{-}CH_2$
W5-1
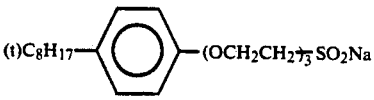
W5-2
$(n)C_4H_9CH(C_2H_5)CH_2COOCH_2$
$(n)C_4H_9CH(C_2H_5)CH_2COOCH(SO_3Na)$
W5-3
$C_8F_{17}SO_2N(C_3H_7)CH_2COOK$ P5-1
Copolymer of vinyl pyrrolidone and vinyl alcohol (70:30 by weight ratio)

F5-1

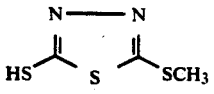

F5-5

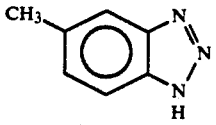

F5-7

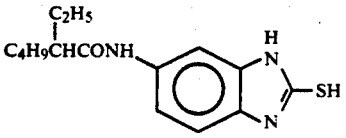

F5-9

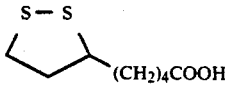

F5-11

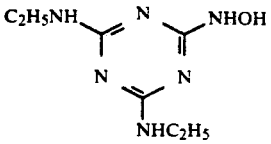

-continued

P5-2
Polyethyl acrylate

F5-4

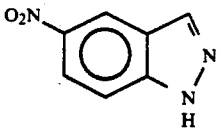

F5-6

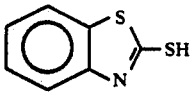

F5-8

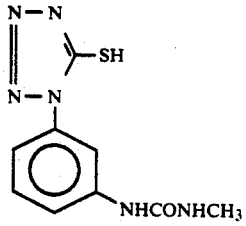

F5-10

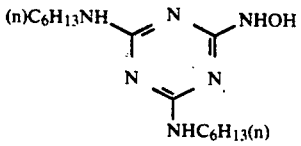

F5-13

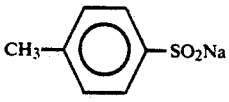

Samples (5A-2) to (5A-7) were prepared in the same manner as described for Sample (5A-1) except that Coupler (7) according to the present invention used in Sample (5A-1) was replaced with an equimolar amount of Couplers (12), (24), (27), (31), (36) and (41) according to the present invention, respectively.

Further, Comparative Samples (5B-1) to (5B-3) were prepared in the same manner as described for Sample (5A-1) except that Coupler (7) according to the present invention used in Sample (5A-1) was replaced with an equimolar amount of Comparative Couplers (M-3), (M-4) and (M-5) used in Example 3 above, respectively.

These samples thus-prepared were subjected to exposure for sensitometry and then processed in an automatic developing machine according to the processing steps shown below.

| Processing Step | Processing Time | Processing Temperature (°C.) |
|---|---|---|
| Color Development | 3 min. 15 sec. | 38 |
| Bleaching | 1 min. 00 sec. | 38 |
| Bleach-Fixing | 3 min. 15 sec. | 38 |
| Washing with Water (1) | 15 sec. | 35 |
| Washing with Water (2) | 1 min. 00 sec. | 35 |
| Stabilizing | 40 sec. | 38 |

-continued

| Processing Step | Processing Time | Processing Temperature (°C.) |
|---|---|---|
| Drying | 1 min. 15 sec. | 55 |

The composition of each processing solution used is illustrated below.

| | |
|---|---|
| Color Developing Solution: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1000 ml |
| pH | 10.05 |
| Bleaching Solution: | |
| Ammonium iron(III) ethylenediaminetetraacetate dihydrate | 120.0 g |
| Disodium ethylenediaminetetraacetate | 10.0 g |
| Ammonium bromide | 100.0 g |
| Ammonium nitrate | 10.0 g |

-continued

| | |
|---|---|
| Bleach accelerating agent | 0.005 mol |

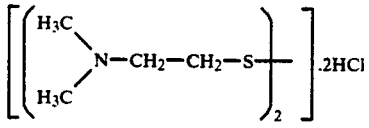

| | |
|---|---|
| Aqueous ammonia (27%) | 15.0 ml |
| Water to make | 1000 ml |
| pH | 6.3 |
| Bleach-Fixing Solution: | |
| Ammonium iron(III) ethylenediamine-tetraacetate dihydrate | 50.0 g |
| Disodium ethylenediaminetetraacetate | 5.0 g |
| Sodium sulfite | 12.0 g |
| Aqueous solution of ammonium thiosulfate (70%) | 240.0 ml |
| Aqueous ammonia (27%) | 6.0 ml |
| Water to make | 1000 ml |
| pH | |

Washing Water

City water was passed through a mixed bed type column filled with an H-type strong acidic cation exchange resin (amberlite IR-120B manufactured by Rhom & Haas Co.) and an OH-type anion exchange resin (Amberlite IR-400 manufactured by Rhom & Haas Co.) to prepare water containing not more than 3 mg/l of calcium ion and magnesium ion. To the water thus-treated were added sodium dichloroisocyanurate in an amount of 20 mg/l and sodium sulfate in an amount of 0.05 g/l. The pH of the solution was in a range from 6.5 to 7.5.

| Stabilizing Solution: | |
|---|---|
| Formalin (37%) | 2.0 ml |
| Polyoxyethylene-p-monononylphenylether (average degree of polymerization: 10) | 0.3 g |
| Disodium ethylenediaminetetraacetate | 0.05 g |
| Water to make | 1.0 l |
| pH | 5.0 to 8.0 |

Each of the samples thus processed was subjected to sensitometry. The results obtained are shown in Table 5 below.

TABLE 5

| Sample | Coupler | Sensitivity (s)* | Gra-dation (Y)** | Maximum Density (Dm) |
|---|---|---|---|---|
| 5A-1 | (7) (Present Invention) | 90 | 2.75 | 2.72 |
| 5A-2 | (12) (Present Invention) | 85 | 2.82 | 2.80 |
| 5A-3 | (24) (Present Invention) | 83 | 2.89 | 2.82 |
| 5A-4 | (27) (Present Invention) | 87 | 2.80 | 2.74 |
| 5A-5 | (31) (Present Invention) | 91 | 2.73 | 2.70 |
| 5A-6 | (36) (Present Invention) | 82 | 2.90 | 2.85 |
| 5A-7 | (41) (Present Invention) | 80 | 2.91 | 2.86 |
| 5B-1 | Comparative Coupler (M-3) | 100 | 2.56 | 2.64 |
| 5B-2 | Comparative Coupler (M-4) | 109 | 2.52 | 2.53 |
| 5B-3 | Comparative Coupler (M-5) | 110 | 2.54 | 2.52 |

*Sensitivity (s) is a value of the exposure amount necessary for providing a density of fog plus 0.5 and shown relatively taking the value of Comparative Sample (5B-1) as 100.

**Gradation (Y) means a slope of a sensitometric curve between a point having a density of 0.5 and a point having a density of 2.5.

From the results shown in table 5, it can be seen that the magenta couplers according to the present invention exhibit high sensitivity and excellent color forming property due to the reduced interaction with silver in comparison with the comparative couplers.

While the invention has been described in detail and with reference to specific embodiments thereof, it will be apparent to one skilled in the art that various changes and modifications can be made therein without departing from the spirit and scope thereof.

What is claimed is:

1. A magenta image forming method which comprises developing a silver halide photographic material with a developing solution containing an aromatic primary amine developing agent in the presence of an imidazo(1,2-b)-pyrazole type coupler represented by the following general formula (I):

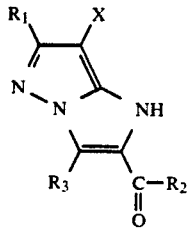

(I)

wherein $R_1$ represents a hydrogen atom, an alkyl group, an alkoxy group, an aryloxy group or an aryl group; $R_2$ represents an alkoxy group, an aryloxy group or a substituted or unsubstituted amino group represented by the following formula:

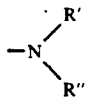

wherein R' and R'', which may be the same or different, each represents a hydrogen atom, or an aryl group, or R' and R'' may combine with each other to form a ring; $R_3$ represents an alkyl group or an aryl group; and X represents a halogen atom or a group bonded to the coupling position through a sulfur atom.

2. The image forming method as claimed in claim 1, wherein the coupler represented by general formula (I) is incorporated into a light-sensitive material.

3. The image forming method as claimed in claim 2, wherein the amount of the coupler represented by general formula (I) is $1\times10^3$ to 1 mol per mol of silver.

4. The image forming method as claimed in claim 1, wherein the coupler represented by general formula (I) is incorporated into a developing solution.

5. The image forming method as claimed in claim 4, wherein the amount of the coupler represented by general formula (I) is from 1 to 6 grams per liter of developing solution.

6. A silver halide color photographic material comprising a support having thereon at least one green-sensitive layer containing an imidazo(1,2-b)pyrazole type coupler represented by the following general formula (I):

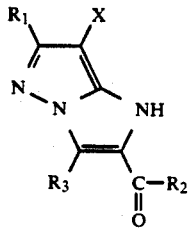

(I)

wherein $R_1$ represents a hydrogen atom, an alkyl group, an alkoxy group, an aryloxy group or an aryl group; $R_2$ represents an alkoxy group, an aryloxy group or a substituted or unsubstituted amino group represented by the following formula:

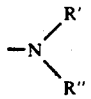

wherein R′ and R″, which may be the same or different, each represents a hydrogen atom, or an aryl group, or R′ and R″ may combine with each other to form a ring; $R_3$ represents an alkyl group or an aryl group; and X represents a halogen atom or a group bonded to the coupling position through a sulfur atom.

7. The silver halide color photographic material as claimed in claim 6, wherein $R_1$ is a substituent having a Hammett's $\sigma_p$ value of not more than 0.1.

8. The silver halide color photographic material as claimed in claim 7, wherein the Hammett's $\sigma_p$ value is in the range of −0.5 to 0.05.

9. The silver halide color photographic material as claimed in claim 6, wherein $R_1$ is an alkyl group, an aryloxy group or an alkoxy group.

10. The silver halide color photographic material as claimed in claim 6, wherein $R_2$ is an alkoxy group or a substituted amino group.

11. The silver halide color photographic material as claimed in claim 6, wherein the imidazo[1,2-b]-pyrazole type coupler is a copolymer composed of a vinyl monomer containing a coupler moiety represented by general formula (I) and a non-color forming ethylenic monomer which does not couple with an oxidation product of an aromatic primary amine developing agent.

12. The silver halide color photographic material as claimed in claim 11, wherein the non-color forming ethylenic monomers which do not couple with the oxidation products of aromatic primary amine developing agents are selected form the group consisting of acrylic acid, an ester derived from an acrylic acid, an amide derived from an acrylic acid, methylene dibisacrylamide, vinyl ester, acrylonitrile, methacrylonitrile, an aromatic vinyl compound, itaconic acid, citraconic acid, crotonic acid, vinylidene chloride, vinyl alkyl ether, maleic acid, maleic anhydride, an ester of maleic acid, N-vinyl-2-pyrrolidone, N-vinyl pyridine, 2-vinyl pyridine and 4-vinyl pyridine.

13. The silver halide color photographic material as claimed in claim 6, wherein the layer containing the imidazo[1,2-b]pyrazole type coupler is a green-sensitive silver halide emulsion layer.

14. The silver halide color photographic material as claimed in claim 13, wherein the silver halide color photographic material further comprises at least one red-sensitive silver halide emulsion layer containing a cyan coupler and at least one blue-sensitive silver halide emulsion layer containing a yellow coupler.

15. The silver halide color photographic material as claimed in claim 6, wherein the alkyl group is a substituted or unsubstituted straight chain or branched chain alkyl group having from 1 to 32 carbon atoms.

16. The silver halide color photographic material as claimed in claim 6, wherein the alkoxy group is a group composed of a substituted or unsubstituted, straight chain or branched chain alkyl group having from 1 to 32 carbon atoms bonded to an oxygen atom and the alkyl moiety of the alkoxy group may be substituted.

17. The silver halide color photographic material as claimed in claim 6, wherein the aryloxy group is an unsubstituted phenoxy or naphthyloxy group or a substituted phenoxy or naphthyloxy group.

18. The silver halide color photographic material as claimed in claim 6, wherein the aryl group is an unsubstituted phenyl or naphthyl group or a substituted phenyl or naphthyl group wherein the substituent groups have a Hammett's value of not more than 0.

* * * * *